US008701932B2

(12) United States Patent
Reinsel et al.

(10) Patent No.: US 8,701,932 B2
(45) Date of Patent: Apr. 22, 2014

(54) CUTLERY DISPENSER TRAYS

(75) Inventors: Christopher M. Reinsel, Neenah, WI (US); Jamison J. Float, Westerville, OH (US); Jay F. Perkins, Pickerington, OH (US); Eric M. Krouse, Dublin, OH (US); Michael T. Kopczewski, Grove City, OH (US); Shawn A. Oakes, Ripon, WI (US)

(73) Assignee: Dixie Consumer Products LLC, Atlanta, GA (US)

( * ) Notice: Subject to any disclaimer, the term of this patent is extended or adjusted under 35 U.S.C. 154(b) by 413 days.

(21) Appl. No.: 13/082,213

(22) Filed: Apr. 7, 2011

(65) Prior Publication Data

US 2011/0180562 A1 Jul. 28, 2011

Related U.S. Application Data

(63) Continuation-in-part of application No. 12/247,805, filed on Oct. 8, 2008.

(51) Int. Cl.

| | |
|---|---|
| ***B65H 3/44*** | (2006.01) |
| ***G07F 11/00*** | (2006.01) |
| ***B65H 1/00*** | (2006.01) |
| ***B65H 3/00*** | (2006.01) |

(52) U.S. Cl.

USPC ..... 221/131; 221/133; 221/163; 221/41; 221/195; 221/197; 221/250; 221/172; 198/382; 198/534; 198/344; 198/416; 209/540; 209/569; 211/70.7

(58) Field of Classification Search

CPC ..... B65H 3/00; B65H 1/00; G07F 11/00

USPC ..... 209/540, 569; 198/382, 534, 344, 416; 221/133, 163, 41, 195, 197, 250, 172; 211/70.7

See application file for complete search history.

(56) References Cited

U.S. PATENT DOCUMENTS

| | | | |
|---|---|---|---|
| 592,105 | A | 10/1897 | Barnes |
| 716,058 | A | 12/1902 | Lang et al. |
| 925,485 | A | 6/1909 | Lafler |
| 999,837 | A | 8/1911 | Morris et al. |
| 1,146,447 | A | 7/1915 | Prommel |

(Continued)

FOREIGN PATENT DOCUMENTS

| | | | |
|---|---|---|---|
| CA | 2545745 | A1 | 11/2006 |
| CN | 2865478 | Y | 2/2007 |

(Continued)

OTHER PUBLICATIONS

Office Action for U.S. Appl. No. 12/349,203 mailed Jun. 15, 2011.

(Continued)

*Primary Examiner* — Gene O. Crawford
*Assistant Examiner* — Rakesh Kumar

(57) ABSTRACT

A utensil dispensing tray that cooperates with a dispenser. The tray includes at least one feature that causes the utensil, such as a knife, fork, spork, or spoon, to rotate from a first orientation to a second orientation for presentation as the utensil drops into the tray. The tray also includes one or more features that result in the utensil being consistently positioned in its second orientation within a dispensing area of the tray.

39 Claims, 21 Drawing Sheets

(56) References Cited

U.S. PATENT DOCUMENTS 1,182,793 A 5/1916 Richardson
1,259,927 A 3/1918 Swift
1,355,583 A 10/1920 Zeidler et al.
1,546,077 A 12/1923 Hunter et al.
1,482,071 A 1/1924 Duff et al.
1,504,098 A 8/1924 Cathey
1,547,151 A 7/1925 Watling
1,560,938 A 11/1925 Lund
1,577,302 A 3/1926 Schultz
1,610,001 A 12/1926 Foster
1,675,510 A * 7/1928 Nolan ..... 221/93
1,767,634 A * 6/1930 Weiss ..... 221/154
1,886,378 A 11/1932 Dearsley
2,053,828 A * 9/1936 Harper ..... 221/277
2,078,984 A 5/1937 Williamson
2,110,189 A 3/1938 Zeidler, Sr.
2,141,684 A 12/1938 Diemer
2,149,098 A 2/1939 Phinney
2,149,099 A 2/1939 Phinney et al.
2,188,573 A 1/1940 Longo
2,207,528 A 7/1940 Witt
2,239,196 A 4/1941 Lunvik
2,260,596 A 10/1941 Young
2,268,596 A 1/1942 Jerum
2,268,873 A 1/1942 Hopkins et al.
2,421,782 A 6/1947 Gibbs et al.
2,427,321 A * 9/1947 Casey et al. ..... 221/272
2,472,051 A 5/1949 Testi
2,503,741 A 4/1950 Johnson
2,571,668 A 10/1951 Booth et al.
2,577,344 A 12/1951 Masure
2,635,025 A 4/1953 Ziska
2,646,874 A 7/1953 Testi
2,671,555 A 3/1954 Shnitzler
2,692,691 A 10/1954 Harriss et al.
2,752,678 A 7/1956 Welch
2,806,634 A 9/1957 Baumgartner
2,868,344 A 1/1959 Shields
2,877,926 A 3/1959 Abbe
2,880,907 A 4/1959 Mainers
2,889,076 A 6/1959 Van Schie
2,911,127 A 11/1959 Driss et al.
2,924,357 A 2/1960 Kingsley et al.
2,946,431 A 7/1960 Nissen
2,954,948 A 10/1960 Johnson
2,965,262 A 12/1960 DuBois
3,083,879 A 4/1963 Coleman
3,095,114 A 6/1963 Tobias
3,100,842 A 8/1963 Tellefsen
3,114,475 A 12/1963 Etes
3,132,765 A 5/1964 Florendo
3,146,908 A * 9/1964 Perri et al. ..... 221/124
3,163,327 A 12/1964 Maxwell
3,180,489 A 4/1965 McGinn
3,263,860 A 8/1966 Haas
3,300,087 A 1/1967 Kuypers
3,313,452 A 4/1967 Katz
3,334,784 A 8/1967 Morrison
3,338,471 A 8/1967 De Good
3,371,821 A 3/1968 Abood, Jr.
3,407,927 A 10/1968 Jones
3,426,941 A 2/1969 Hovekamp
3,472,421 A 10/1969 Baller
3,499,538 A 3/1970 Sherard
3,558,006 A 1/1971 Redmond
3,587,922 A 6/1971 Oriti
3,654,396 A * 4/1972 Biezeveld ..... 379/199
3,680,736 A 8/1972 Viessman
3,786,959 A 1/1974 Greb et al.
3,972,118 A * 8/1976 Richard ..... 30/298.4
4,091,915 A * 5/1978 Claasen ..... 198/389
4,134,519 A 1/1979 Barnett et al.
4,146,123 A * 3/1979 Cottrell ..... 198/382
4,308,974 A 1/1982 Jones
4,489,854 A 12/1984 Wenkman et al.
4,524,512 A 6/1985 Formo et al.
4,570,536 A 2/1986 Dodd
4,571,773 A 2/1986 Yuda
4,574,423 A 3/1986 Ito et al.
4,610,087 A 9/1986 Michelson et al.
4,614,004 A 9/1986 Oshida
4,662,536 A 5/1987 Powers
4,691,811 A 9/1987 Arakawa et al.
4,697,673 A 10/1987 Omata
4,707,251 A * 11/1987 Jenkins et al. ..... 209/569
4,715,514 A 12/1987 Vidondo
4,789,064 A 12/1988 Segal
4,896,792 A 1/1990 Marchand
4,921,106 A * 5/1990 Spatafora et al. ..... 209/539
4,973,037 A 11/1990 Holbrook
4,986,442 A 1/1991 Hinterreiter
5,080,257 A * 1/1992 Carnisio ..... 221/113
5,127,546 A 7/1992 Chen
5,131,586 A 7/1992 Capy
5,191,997 A 3/1993 Squitieri
5,211,267 A 5/1993 Clark
5,249,705 A 10/1993 Gates
D342,648 S 12/1993 Cautereels et al.
5,269,397 A 12/1993 Kawamoto et al.
2,340,561 A 2/1994 Renfro
5,364,016 A 11/1994 Capy et al.
5,413,317 A 5/1995 Spoerre
5,449,054 A 9/1995 Wiese et al.
5,460,252 A 10/1995 Kosugi et al.
5,469,688 A 11/1995 Dunbar et al.
5,497,863 A 3/1996 Schmidt et al.
5,509,522 A 4/1996 Laidlaw
5,542,508 A 8/1996 Van Erden et al.
5,564,594 A 10/1996 Monfredo
5,586,685 A 12/1996 Dorner et al.
5,590,472 A 1/1997 Yaakov
5,605,208 A 2/1997 Friedrichsen et al.
5,660,252 A 8/1997 Lafon
5,904,250 A 5/1999 DeSchutter
5,921,408 A 7/1999 Groenewold et al.
5,950,842 A * 9/1999 Baur ..... 209/540
5,961,021 A 10/1999 Koike et al.
6,023,913 A 2/2000 Gray et al.
6,047,830 A 4/2000 Chang
6,202,891 B1 * 3/2001 Mark ..... 221/196
6,250,498 B1 6/2001 Lovejoy
6,298,960 B1 10/2001 Derr
6,336,568 B1 * 1/2002 Tucker et al. ..... 221/131
6,378,729 B1 4/2002 Kodama
6,626,633 B2 9/2003 Jendzurski et al.
6,651,841 B2 11/2003 Tsuchida
D492,549 S 7/2004 Welch
D493,337 S 7/2004 Welch
6,763,972 B2 7/2004 Graupner
6,786,357 B2 * 9/2004 Renard ..... 221/197
6,786,359 B1 * 9/2004 Schroeder ..... 221/222
6,832,694 B2 * 12/2004 Goeking et al. ..... 221/195
6,837,028 B1 1/2005 Miano et al.
6,840,353 B2 1/2005 Arisaka
6,945,427 B2 9/2005 Hieb
6,972,033 B2 12/2005 McNicholas
6,976,348 B1 12/2005 Miano et al.
7,076,932 B2 7/2006 Rubin
7,090,455 B2 8/2006 Lamb
7,210,279 B1 5/2007 Ahmed et al.
7,322,172 B2 1/2008 Hoffman et al.
7,412,808 B2 8/2008 Lavi
D591,104 S 4/2009 Oakes
7,513,089 B2 4/2009 Rubin
7,516,831 B2 4/2009 Chang
7,520,247 B2 4/2009 Rutledge
7,819,234 B2 * 10/2010 Herzog ..... 198/399
8,070,013 B2 12/2011 Reinsel et al.
8,152,004 B2 4/2012 Smith et al.
8,272,533 B1 * 9/2012 D'Amelia et al. ..... 221/197
8,297,473 B2 * 10/2012 Smith ..... 221/129
8,360,273 B2 * 1/2013 Reinsel et al. ..... 221/131
2002/0112445 A1 8/2002 Scaduto
2003/0015399 A1 * 1/2003 Bennett ..... 198/416

(56) References Cited

U.S. PATENT DOCUMENTS

| | | | | |
|---|---|---|---|---|
| 2003/0015824 | A1 | 1/2003 | Forbes et al. | |
| 2003/0146061 | A1 | 8/2003 | Tourner | |
| 2004/0045398 | A1 | 3/2004 | Hayashi | |
| 2004/0045860 | A1 | 3/2004 | Edgerly et al. | |
| 2004/0089670 | A1 | 5/2004 | Goeking et al. | |
| 2005/0082307 | A1 | 4/2005 | Tucker | |
| 2005/0155229 | A1 | 7/2005 | Lee | |
| 2005/0230222 | A1* | 10/2005 | Olson et al. | 198/465.1 |
| 2005/0252057 | A1 | 11/2005 | Lavi | |
| 2006/0000190 | A1 | 1/2006 | Behnke et al. | |
| 2007/0108141 | A1 | 5/2007 | Smith et al. | |
| 2007/0131705 | A1 | 6/2007 | Behravesh et al. | |
| 2007/0193968 | A1 | 8/2007 | Smith et al. | |
| 2008/0121650 | A1 | 5/2008 | Smith | |
| 2008/0128445 | A1 | 6/2008 | Huang et al. | |
| 2009/0194557 | A1 | 8/2009 | Van Deursen | |
| 2010/0084418 | A1 | 4/2010 | Reinsel et al. | |
| 2010/0147869 | A1 | 6/2010 | Iliffe et al. | |
| 2010/0170915 | A1 | 7/2010 | Reinsel et al. | |
| 2011/0226797 | A1 | 9/2011 | Reinsel et al. | |
| 2011/0296693 | A1 | 12/2011 | Oakes | |
| 2012/0036724 | A1 | 2/2012 | Walters | |
| 2012/0047744 | A1 | 3/2012 | Walters | |
| 2012/0080444 | A1 | 4/2012 | Smith et al. | |
| 2012/0145734 | A1 | 6/2012 | Walters | |
| 2012/0145735 | A1 | 6/2012 | Erickson et al. | |
| 2012/0145736 | A1 | 6/2012 | Walters et al. | |
| 2013/0032609 | A1* | 2/2013 | Righetti et al. | 221/103 |
| 2013/0043272 | A1 | 2/2013 | Oakes | |
| 2013/0152406 | A1 | 6/2013 | McFarland | |
| 2013/0193157 | A1 | 8/2013 | Jongen et al. | |

FOREIGN PATENT DOCUMENTS

| | | | |
|---|---|---|---|
| DE | 7033238 | | 11/1970 |
| DE | 7127677 | | 11/1971 |
| DE | 3151268 | | 7/1983 |
| DE | 4139938 | A1 | 6/1993 |
| DE | 9316566 | U1 | 1/1994 |
| DE | 19906369 | C1 | 2/2000 |
| DE | 202005013647 | U1 | 7/2006 |
| EP | 0856272 | A3 | 1/1999 |
| EP | 1022107 | A1 | 7/2000 |
| EP | 1217923 | B1 | 9/2003 |
| EP | 1358827 | A2 | 11/2003 |
| EP | 1213985 | B1 | 6/2004 |
| EP | 1514497 | A1 | 3/2005 |
| EP | 1719438 | A1 | 11/2006 |
| EP | 1864596 | A2 | 12/2007 |
| FR | 2889507 | A1 | 2/2007 |
| JP | 08-047440 | | 2/1996 |
| JP | 2007-319493 | A | 12/2007 |
| KR | 20-1991-0008085 | Y1 | 10/1991 |
| WO | 01/05280 | A1 | 1/2001 |
| WO | 01/05281 | A1 | 1/2001 |
| WO | 01/68492 | A1 | 9/2001 |
| WO | 2004/028309 | A1 | 4/2004 |
| WO | 2007/049982 | A1 | 5/2007 |
| WO | 2007/124606 | A1 | 11/2007 |
| WO | 2008/058187 | A3 | 5/2008 |
| WO | 2009137367 | A2 | 11/2009 |

OTHER PUBLICATIONS

Peel Adhesion for Single Coated Pressure-Sensitive Tapes 180 Angle, Aug. 1989, pp. 21-22.

Tack Rolling Ball, Aug. 1989, pp. 29-30.

Holding Power of Pressure-Sensitive Tape, Aug. 1989, pp. 31-33.

Office Actions for U.S. Appl. No. 11/556,808, filed Nov. 6, 2006.

Office Action for U.S. Appl. No. 11/415,836, filed May 2, 2006.

Office Actions for U.S. Appl. No. 11/936,401, filed Nov. 7, 2007.

* cited by examiner

CUTLERY DISPENSER TRAYS

CROSS REFERENCE TO RELATED APPLICATIONS

This application is a continuation-in-part application of U.S. Ser. No. 12/247,805 filed on Oct. 8, 2008 and titled "Cutlery Utensil Dispenser," the contents of which are hereby incorporated by reference.

RELATED FIELDS

Cutlery utensil dispensers, and more particularly, dispenser trays for use in cutlery utensil dispensers.

BACKGROUND

Eating facilities often provide cutlery utensils in dispensing bins, where all customers place their hands into the bins to retrieve a fork, spoon, knife, or spork. Open air bins are relatively unhygienic and can spread hand-carried bacteria and the like to other utensils in the bin or to another customer.

To address concerns relating to dispensing of hygienic cutlery utensils, enclosed dispensers have been used where a stack of cutlery utensils is placed in a utensil compartment and dispensed one at a time on command by operation of a dispensing lever. U.S. Ser. No. 12/247,805, which was filed Oct. 8, 2008, is titled "Cutlery Utensil Dispenser," and the contents of which are hereby incorporated by reference, describes one such dispenser. As described in that application, the dispenser includes a dispensing tray that engages a dispensed utensil and causes the dispensed utensil to rotate from a first orientation to a second orientation as the dispensed utensil slides down the tray.

SUMMARY

Disclosed are improved trays for use in cutlery utensil dispensers.

According to some versions, there is provided a cutlery dispenser comprising: (a) a housing for storing one or more stacks of utensils in a first orientation; (b) a tray located below the one or more stacks of utensils and configured to receive a piece of cutlery from the one more stacks of utensils, the tray further comprising: (i) a front and at least one side; (ii) a presentation area positioned along the front of the tray; (iii) a drop area for receiving a utility end of the piece of cutlery, wherein the drop area is not in the same plane as the presentation area; (iv) a channel connecting the drop area and the presentation area; (v) an angled receiving surface for receiving the piece of cutlery, the angled receiving surface located on the at least one side of the tray, wherein a handle end of the piece of cutlery contacts the angled receiving surface and is adapted to move ahead of the utility end of the piece of cutlery; and (vi) a ledge for preventing over-rotation of the piece of cutlery as it rotates into a second orientation after contacting the angled receiving surface, the ledge promoting correct positioning of the piece of cutlery within the presentation area of the tray; and (c) a presentation opening that is at least partially aligned with the presentation area of the tray.

Additional or alternate versions provide a cutlery dispenser wherein the housing of the dispenser stores two stacks of utensils.

Additional or alternate versions provide a cutlery dispenser wherein the channel is shaped to receive one of a fork, a spoon, a knife or a spork.

Additional or alternate versions provide a cutlery dispenser further comprising an anti-jam surface, at least a portion of the anti-jam surface located behind and positioned higher than the angled receiving surface.

Additional or alternate versions provide a cutlery dispenser wherein the slope of the angled receiving surface is between approximately 10 degrees and approximately 60 degrees.

Additional or alternate versions provide a cutlery dispenser further comprising a second sloped surface connecting the anti-jam surface with the ledge.

Additional or alternate versions provide a cutlery dispenser further comprising one or more tabs for properly aligning the tray within the dispenser.

Additional or alternate versions provide a cutlery dispenser further comprising a generally planar ledge that extends from the second sloped surface, the generally planar ledge adapted to maintain the utility end of a dispensed piece of cutlery lower than the handle end of the cutlery as the dispensed piece of cutlery rotates toward the presentation area into the second orientation.

Additional or alternate versions provide a cutlery dispenser wherein the dispenser further comprises a sensor and wherein the presentation area of the tray further comprises an aperture through which a beam associated with the sensor passes.

Additional or alternate versions provide a cutlery dispenser wherein a slope of the anti-jam surface is between approximately 45 degrees and approximately 90 degrees.

Additional or alternate versions provide a cutlery dispenser further comprising one or more ribs on the at least one side of the tray, the one or more ribs adapted to contact the handle end of the piece of cutlery, wherein a dimension of the one or more ribs is generally inversely related to a length of the piece of cutlery.

Also provided is a tray for use within a cutlery dispenser for receiving and presenting single utensils, the tray comprising: (a) a front, a back, and two sides; (b) a presentation area positioned along the front of the tray; (c) a drop area for receiving a utility end of one of the single utensils, the drop area positioned in a plane lower than a plane of the presentation area; (d) a channel connecting the drop area and the presentation area, wherein the channel receives a mid-section of the utensil; (e) an angled utensil receiving surface located on one of the two sides of the tray such that when a handle end of the utensil contacts the angled receiving surface, the handle end is adapted to move toward the presentation area ahead of the utility end of the utensil; and (f) a ledge adapted to prevent rotation of the utensil beyond about 45 degrees after the utensil contacts the angled receiving surface.

Additional or alternate versions provide a tray wherein the presentation area further comprises an aperture that corresponds to a sensing beam.

Additional or alternate versions provide a tray further comprising an anti-jam surface, at least a portion of the anti-jam surface located behind and positioned higher than the angled receiving surface.

Additional or alternate versions provide a tray wherein a slope of the anti-jam surface is between approximately 45 degrees and approximately 90 degrees.

Additional or alternate versions provide a tray further comprising ribs on a side of the tray, the ribs adapted to contact the handle of the utensil, wherein the dimension of the ribs is generally inversely related to a length of the utensil.

Additional or alternate versions provide a tray further comprising tabs for aligning the tray within the dispenser.

Additional or alternate versions provide a tray wherein the slope of the angled utensil receiving surface is between approximately 10 degrees and approximately 60 degrees.

Additional or alternate versions provide a tray further comprising a second sloped surface connecting the anti-jam surface with the ledge.

Also provided is a tray for use within a cutlery dispenser for receiving and presenting utensils, the tray comprising: (a) a front, a back, and two sides; (b) a presentation area positioned along the front of the tray; (c) a drop area for receiving a utility end of one of the utensils, the drop area positioned in a plane lower than a plane of the presentation area; (d) a channel connecting the drop area and the presentation area, wherein the channel receives a mid-section of the utensil; and (e) an angled utensil receiving surface located on one of the two sides of the tray, wherein a handle of the utensil contacts the angled utensil receiving surface and is adapted to move toward the presentation area ahead of the utility end of the utensil.

Additional or alternate versions provide a tray wherein the presentation area further comprises an aperture that corresponds to a sensing beam.

Additional or alternate versions provide a tray further comprising an anti-jam surface, at least a portion of the anti-jam surface located behind and positioned higher than the angled receiving surface.

Additional or alternate versions provide a tray wherein a slope of the anti-jam surface is between approximately 45 degrees and approximately 90 degrees.

Additional or alternate versions provide a tray further comprising ribs on at least one of the sides of the tray, the ribs adapted to contact the handle of the utensil, wherein the dimension of the ribs is generally inversely related to a length of the utensil.

Additional or alternate versions provide a tray further comprising tabs for aligning the tray within the dispenser.

Additional or alternate versions provide a tray wherein the slope of the angled utensil receiving surface is between approximately 10 degrees and approximately 60 degrees.

Additional or alternate versions provide a tray further comprising a ledge for preventing rotation of the utensil beyond about 45 degrees after the utensil contacts the angled utensil receiving surface.

Additional or alternate versions provide a tray further comprising a second sloped surface connecting the anti-jam surface with the ledge.

Also provided is a tray for use within a cutlery dispenser for receiving and presenting forks, the tray comprising: (a) a front, a back, and two sides; (b) a presentation area positioned along the front of the tray; (c) a drop area for receiving a utility end of one of the forks, the drop area positioned in a plane below a plane of the presentation area; (d) a channel connecting the drop area and the presentation area, the channel for receiving a mid-section of the fork; and (e) an angled fork receiving surface located on one of the two sides of the tray, wherein a handle of the fork contacts the angled fork receiving surface and is adapted to move toward the presentation area ahead of the utility end of the fork.

Additional or alternate versions provide a tray wherein the presentation area further comprises an aperture that corresponds to a sensing beam.

Additional or alternate versions provide a tray further comprising an anti-jam surface, at least a portion of the anti-jam surface located behind and positioned higher than the angled receiving surface.

Additional or alternate versions provide a tray wherein a slope of the anti-jam surface is between approximately 45 degrees and approximately 90 degrees.

Additional or alternate versions provide a tray further comprising ribs on a right side of the tray, the ribs adapted to contact the handle of the fork, wherein the dimension of the ribs is generally inversely related to a length of the fork.

Additional or alternate versions provide a tray further comprising tabs for aligning the tray within the dispenser.

Additional or alternate versions provide a tray wherein the slope of the angled fork receiving surface is between approximately 10 degrees and approximately 60 degrees.

Additional or alternate versions provide a tray further comprising a first ledge adapted to prevent rotation of the fork beyond about 45 degrees after the fork contacts the angled fork receiving surface.

Additional or alternate versions provide a tray further comprising a second sloped surface connecting the anti-jam surface with the first ledge.

Additional or alternate versions provide a tray further comprising a generally planar ledge that extends from the second sloped surface, the generally planar ledge positioned to maintain the utility end of the fork lower than the handle end of the fork as the fork rotates toward the presentation area.

Additional or alternate versions provide a tray further comprising a guide surface that projects from the presentation area toward the back of the tray to help prevent the fork from balancing on one of its sides.

Applicants do not wish to be bound by the forgoing or any other understanding of how their invention or any of the prior art works.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the following appended figures, in which use of like reference numerals in different figures is intended to illustrate like or analogous components.

DETAILED DESCRIPTION

Figures 1, 2:
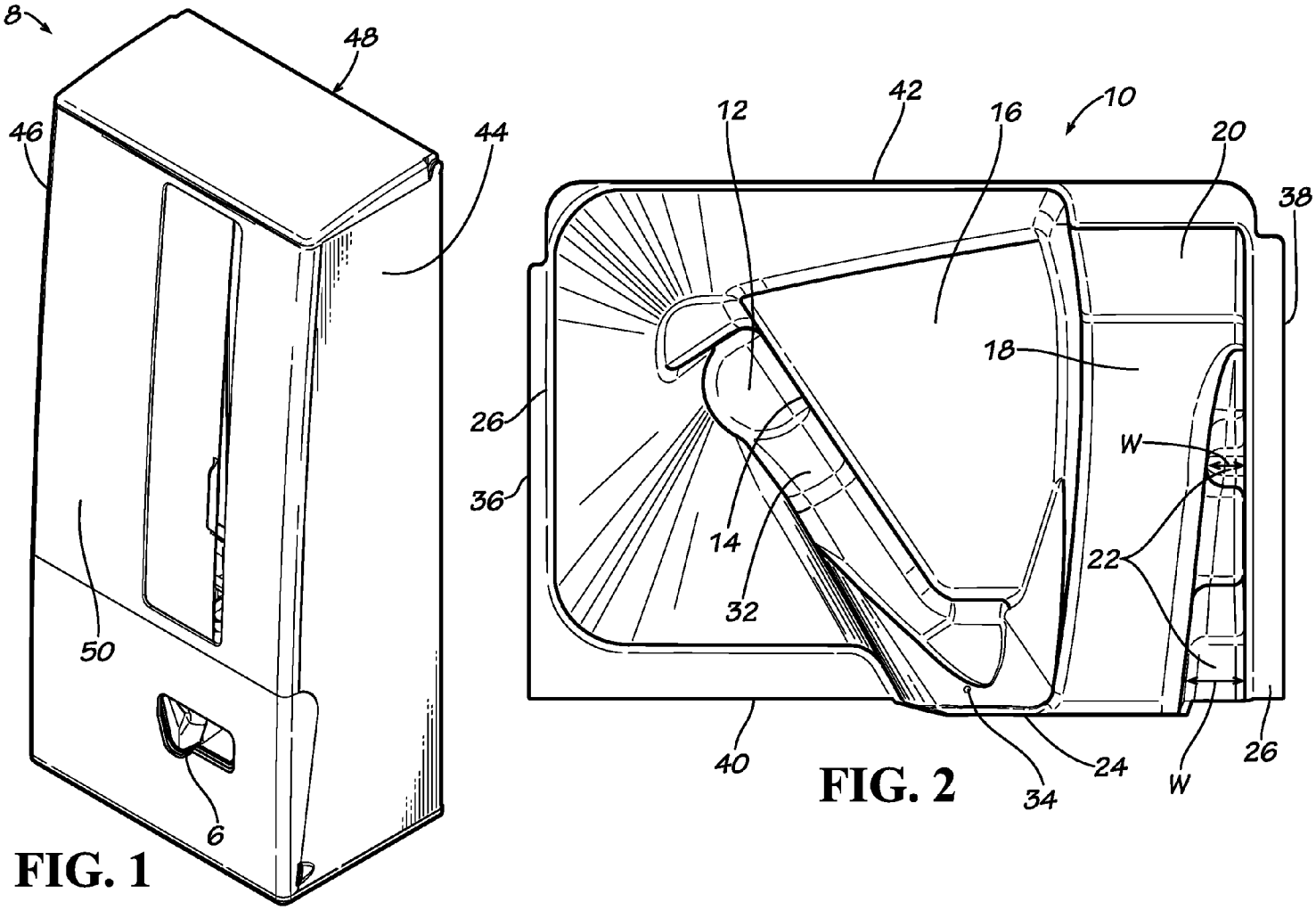
FIG. 1 is a front perspective view of a knife dispenser according to one embodiment.
FIG. 2 is a top view of a knife tray of the knife dispenser of FIG. 1.

FIG. 1 illustrates a dispenser 8, such as a knife dispenser, that is configured to house one or more stacks of utensils, such as one or more stacks of knives, spoons, forks, or sporks. As is known, utensils, including knives, have a handle end and a utility end. The dispenser has a drive member that is associated with each stack of utensils and that causes a utensil to be dispensed from that particular stack, such as is disclosed in U.S. Ser. No. 12/247,805 filed on Oct. 8, 2008, the contents of which have been incorporated herein by reference. In some embodiments, if two stacks of knives are housed within dispenser 8, a first stack is positioned closer to the front 50 of the dispenser 8 and a second stack is positioned behind the first stack closer to the back 48 of the dispenser 8. Directional terms used herein such as "front," "right," "middle," "back," "left," etc. are all relative terms in reference to the Figures.

Dispenser 8 also houses a utensil tray, such as knife tray 10 shown in FIGS. 2-11, located below the one or more stacks of utensils. Knife tray 10 is positioned to receive a utensil after the utensil has been dispensed from the stack. In some embodiments, dispenser 8 is configured so that each of the knives in a stack is stored in a first orientation above tray 10. In the first orientation, the knife is generally oriented in a left-to-right direction so that the handle end of the knife is positioned toward the right side 44 of the dispenser 8 and the utility end of the knife is positioned toward the left side 46 of the dispenser 8. When a consumer activates dispenser 8, the knife is dropped in any suitable manner into tray 10. In some embodiments, the knife falls by gravity after the drive member dispenses the knife from the stack.

Figure 3:
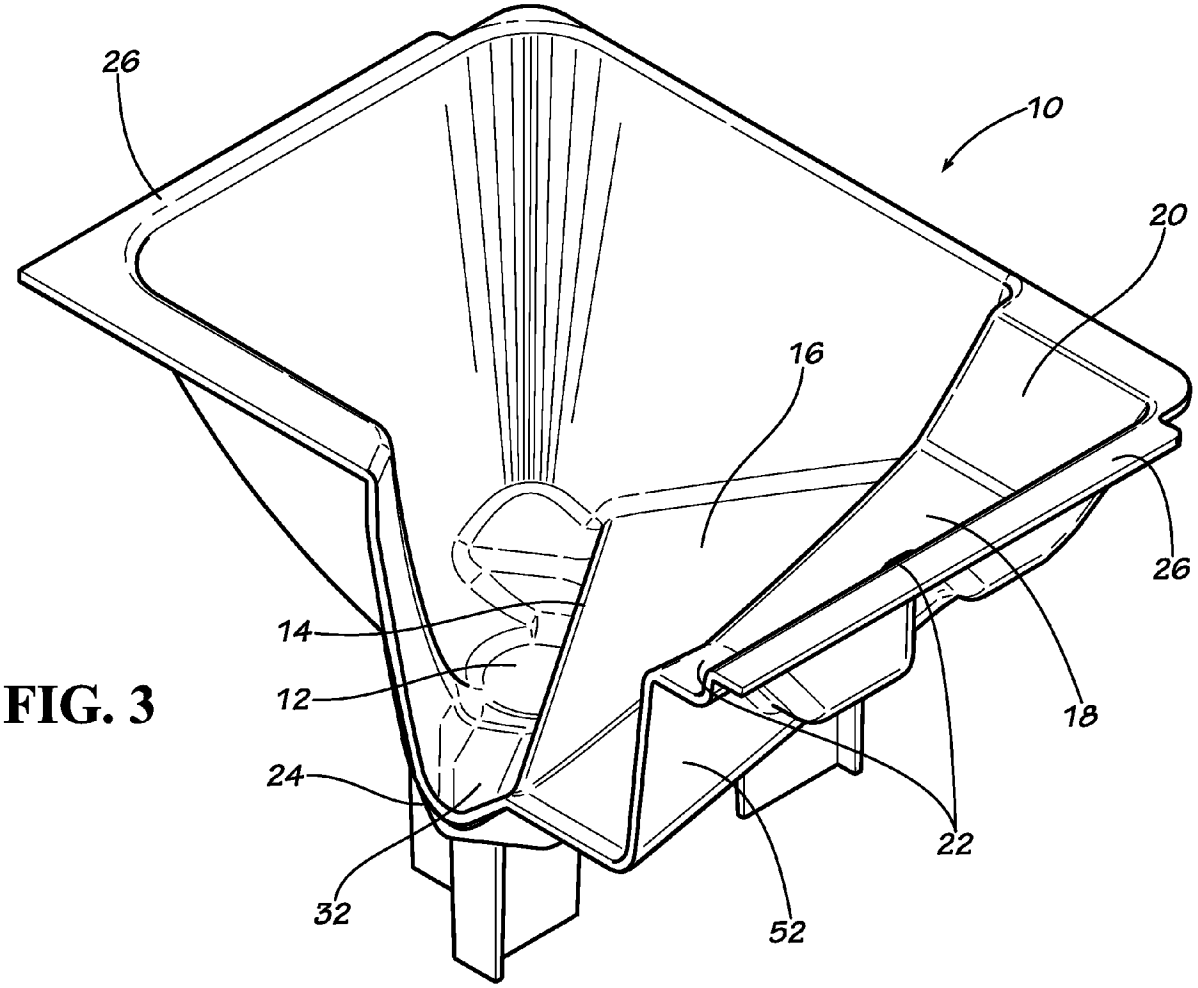
FIG. 3 is a front top perspective view of the knife tray of FIG. 2.
Figure 4:
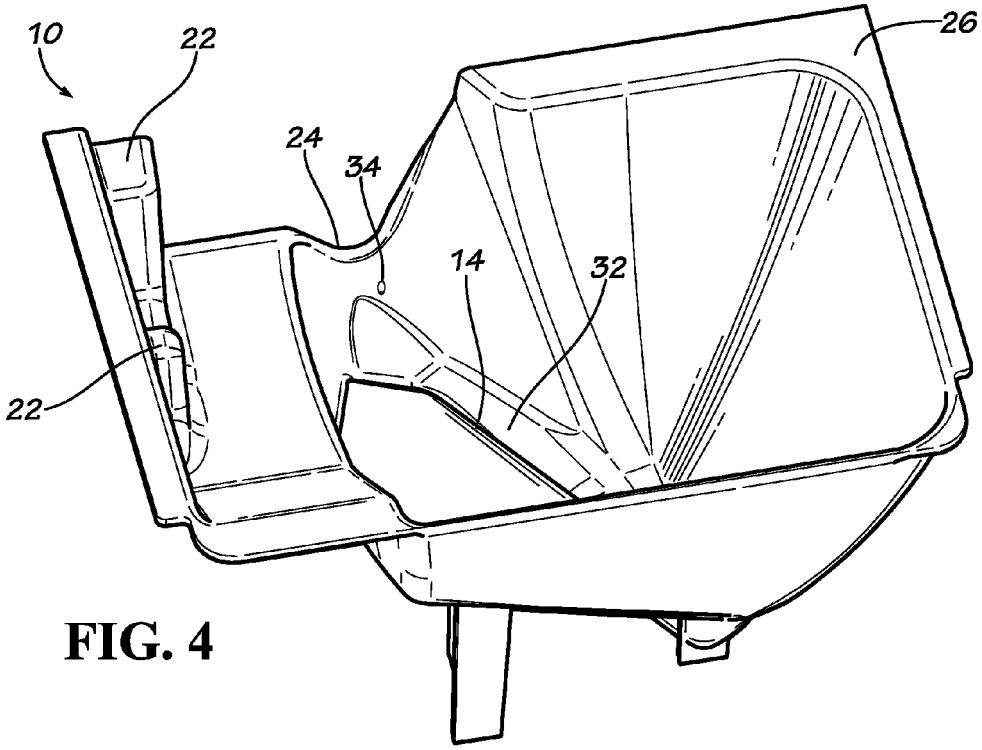
FIG. 4 is a rear top perspective view of the knife tray of FIG. 2.
Figure 5:
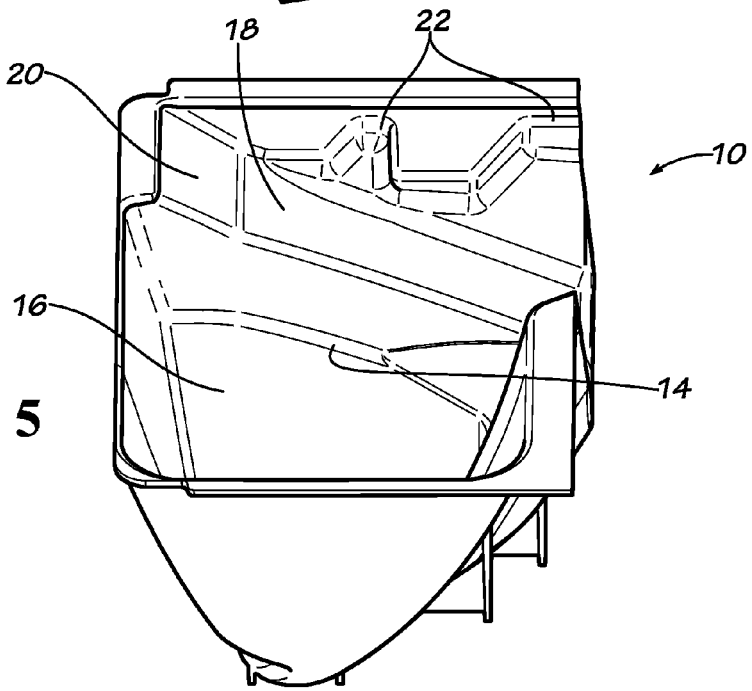
FIG. 5 is a side top perspective view of the knife tray of FIG. 2.
Figure 6:
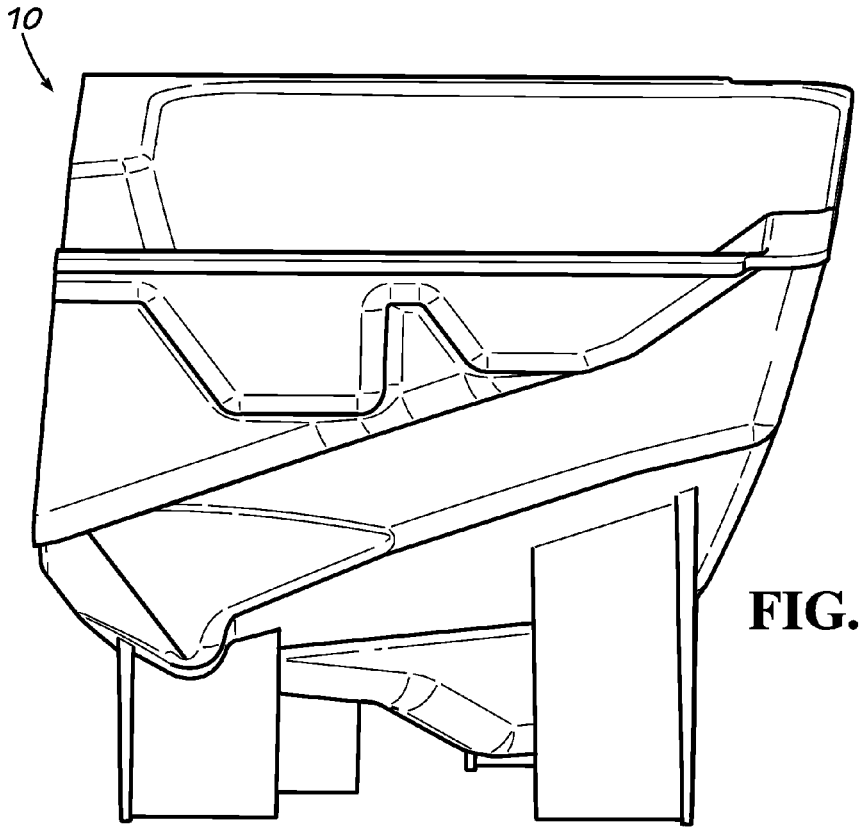
FIG. 6 is a right side perspective view of the knife tray of FIG. 2.
Figure 7:
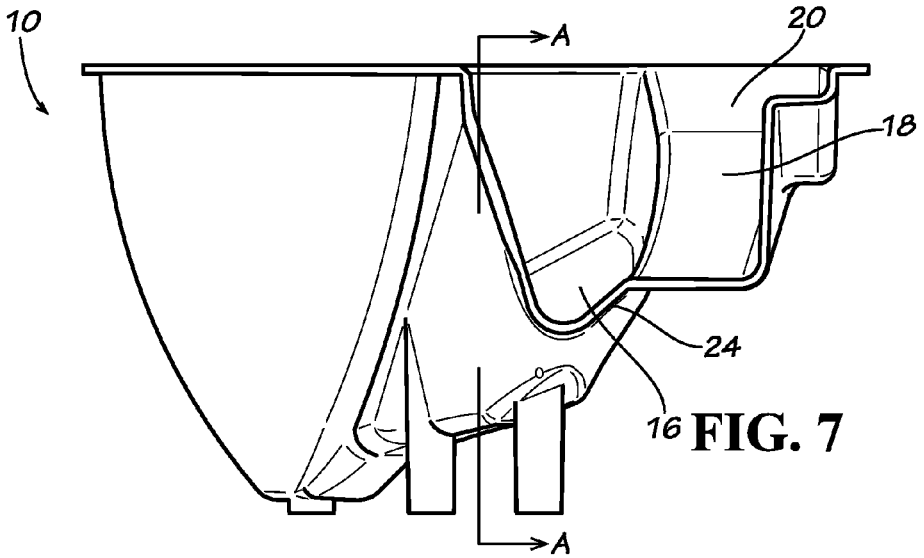
FIG. 7 is a front view of the knife tray of FIG. 2.
Figure 8:
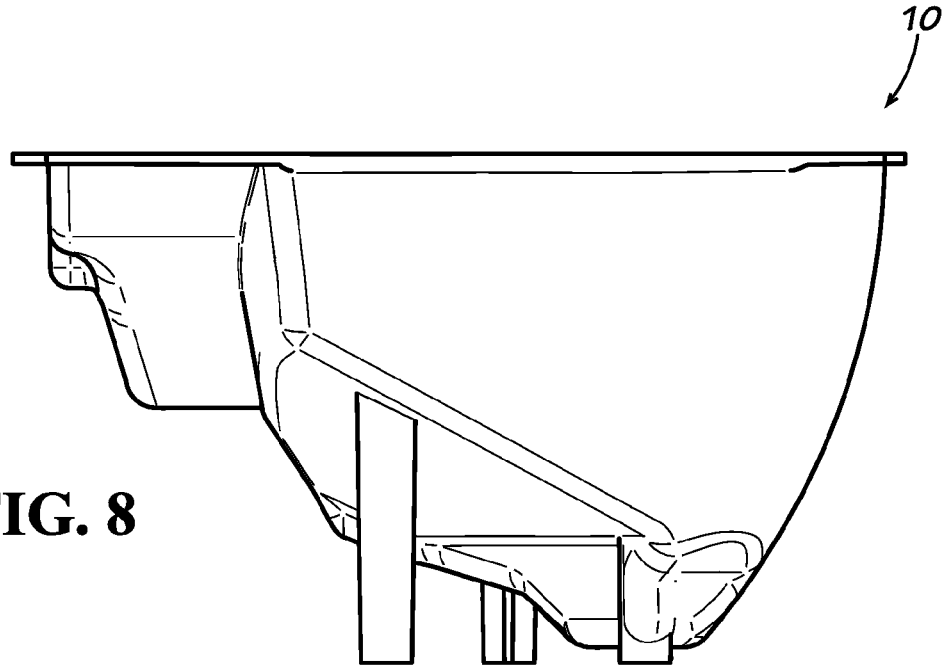
FIG. 8 is a rear view of the knife tray of FIG. 2.
Figure 9:
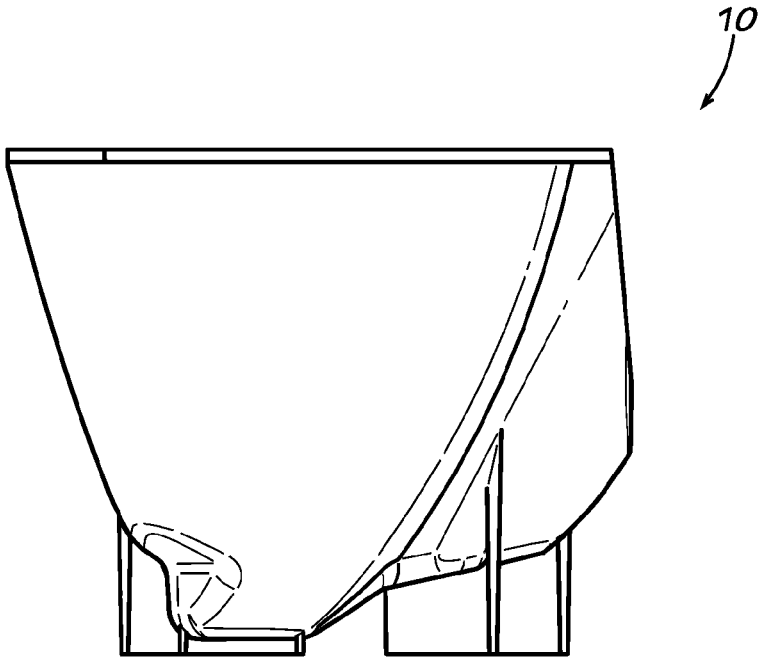
FIG. 9 is a left side view of the knife tray of FIG. 2.
Figure 10:
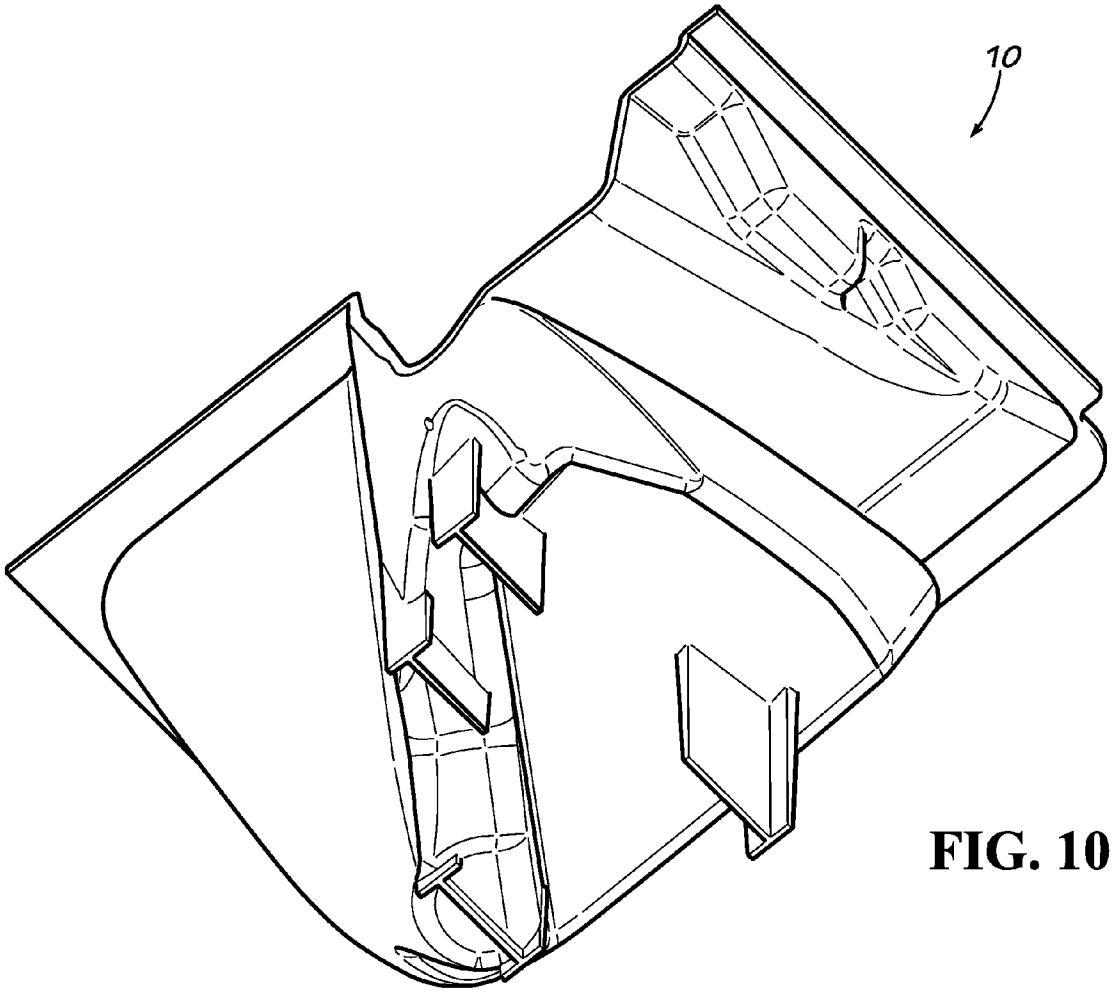
FIG. 10 is a bottom perspective view of the knife tray of FIG. 2.
Figure 11:
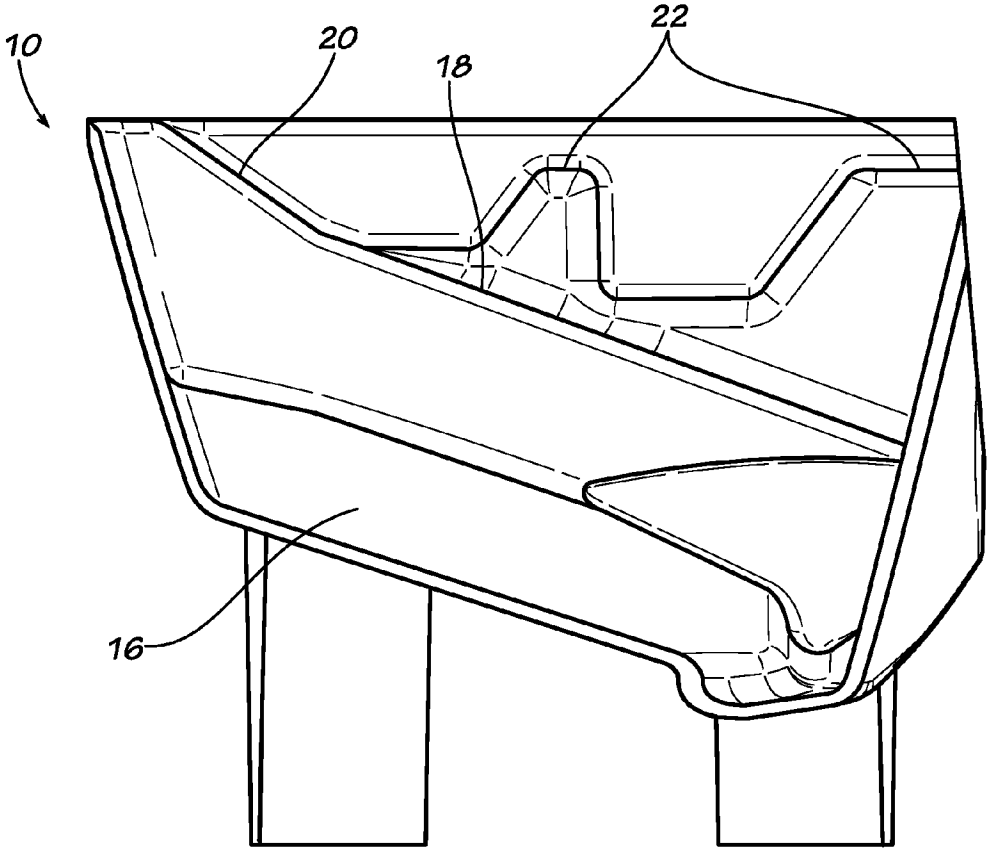
FIG. 11 is a cross-sectional view of the knife tray of FIG. 2, taken along the line A-A of FIG. 7.
Figure 13:
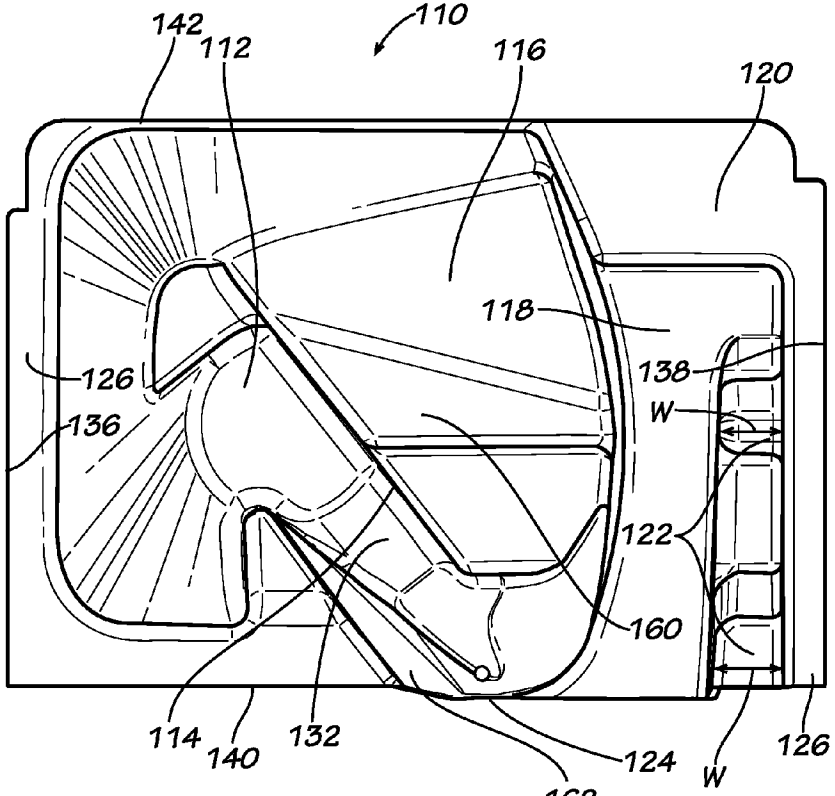
FIG. 13 is a top view of a fork tray to be used with the fork dispenser of FIG. 12.

As shown in FIG. 1, knife dispenser 8 includes an opening 6 into which a portion of the handle end of a knife is designed to come to rest after it is dispensed from the stack into the tray 10 so that a user may access the dispensed knife. Opening 6 should at least partially align with a presentation area 24 of knife tray 10 (FIGS. 3 and 7).

In some embodiments, presentation area 24 is positioned along the front 40 of the tray 10 and is generally V-shaped so that the handle end of the utensil rests in a particular location within presentation area 24 after the utensil is dispensed. The V-shape helps prevent the utensil from resting on its side. In some embodiments, presentation area 24 is shaped so that the handle end of the knife rests centrally within presentation area 24.

Specifically, in some embodiments, after dispensing, the handle end of the knife comes to rest so that it blocks an aperture 34 (FIG. 2) through which an infrared beam shines by means of an infrared emitter. In such embodiments, the light beam serves as a sensor that senses whether a knife is present in presentation area 24. The sensor, and thus the presentation area 24, can be positioned in various locations about tray 10. Alternatively, the sensor could be positioned along the base of the tray 10 or within the drop area 12, described below. Other suitable sensor mechanisms may be used instead of an aperture in the tray. For example, the tray may be formed from translucent material, or the sensor could be weight activated.

In the illustrated embodiment, if a knife has been removed from the presentation area 24, the dispenser 8 dispenses another knife. In other embodiments of dispenser 8, the dispensing of the utensil is not automated. In these and other instances, the presentation area 24 may be oriented and configured differently. For example, presentation area 24 can have other shapes besides a general V-shape.

In addition to presentation area 24, knife tray 10 includes several features that aid in consistent dispensing of each knife from the one or more stacks—that is, the tray 10 includes one or more features to help ensure that as a knife is dispensed from a stack into the dispensing tray 10, the knife consistently lands in a desired position and orientation within the tray. In some embodiments, it is desirable for the handle end of the knife to rest within presentation area 24 so that it projects out of opening 6 so that a user can readily access the handle end of the dispensed knife. As mentioned above, in some embodiments, it may be desired that the handle end of the knife also lands within presentation area 24 so that the dispenser is able to sense the presence of the knife. In some embodiments, it is desirable for the utility end of the knife to come to rest within a drop area 12 of knife tray 10 (FIG. 2). Drop area 12 can have various shapes and sizes, and in some embodiments may be shaped and sized to correspond to the utility end of the utensil to be received within tray 10.

In some embodiments, drop area 12 is the lowest point on the tray 10. In other words, the drop area 12 is positioned lower than the presentation area 24, causing the knife to rest at an angle within tray 10. In these embodiments, the handle end of the knife is positioned higher than the utility end of the knife when the knife is presented within tray 10. The portion of the knife is received within channel 32, which extends between the drop area 12 and the presentation area 24.

As shown in FIG. 2, the width of the channel 32 may vary depending on the shape of the utensil to be received within channel 32. For example, channel 32 may be tapered to correspond to the shape of a knife or other utensil.

As discussed above, the stacks of knives may be positioned within the dispenser 8 in a first orientation so that each knife extends in a generally left-to-right direction along dispenser 8. As the knife drops into knife tray 10, the knife rotates into a second orientation such that the handle end of the knife lands in presentation area 24. More specifically, the handle end of the knife moves from the right 44 of the dispenser and also rotates toward the front 50 of the dispenser. In such embodiments, as the knife moves from its first orientation into its second orientation, the knife clockwise rotates approximately 45°.

As shown in FIG. 2, an angled receiving surface 18 is positioned on the right side 38 of the tray 10. Because the knife is oriented in a first orientation in which the handle end of the knife is positioned on the right 44 of the dispenser 8, when the knife drops from the stack into tray 10, the handle end of the knife contacts angled receiving surface 18. Angled receiving surface 18 is downwardly sloped toward the front 40 of the tray so that the surface facilitates rotation of the knife as the handle end of the knife contacts the receiving surface 18. Specifically, angled receiving surface 18 is configured so that the handle end of the knife rotates from the right side 38 of the tray 10 toward the front 40 of the tray 10 after contacting angled receiving surface 18. Angled receiving surface 18 is configured to promote movement of the handle end down the surface 18. The desired degree of the slope of the angled receiving surface 18 is related to the height from which the knife drops from the stack onto the tray 10. In this way, the degree of the slope of the angled receiving surface 18 is negatively correlated with the drop height of the knife. The correlation also depends at least in part on the material of the tray, the material of the utensil, the surface roughness of the tray, the drop position (i.e., front/back), the angle of the slope of the angled receiving surface 18, and the geometry of the utensil. In some embodiments, the degree of the slope of the angled receiving surface 18 is in a range of about 10-60 degrees when associated with a drop height of about 1-6 inches. In some embodiments, the degree of the slope of angled receiving surface 18 is around 20 degrees for a drop height of about 2-4 inches, and more specifically, about 3 inches. Other suitable degrees of slope may be used depending on the height from which the knife drops, and depending on the number of stacks of utensils stored within the dispenser. In general, the greater the drop height, the more kinetic energy the utensil has when it reaches the tray 10 and therefore less of an angle is required for angled receiving surface 18.

In embodiments where the dispenser 8 includes two stacks of knives such that one stack is positioned closer to the front 50 of the dispenser and the other stack is positioned closer to the back 48 of the dispenser, tray 10 optionally may include an anti-jam surface 20. Anti-jam surface 20 is located behind angled surface 18 so that it is positioned more toward the back 42 of the tray 10. In this way, the handle ends of knives that are dispensed from the stack located closer to the back 48 of the dispenser first contact anti-jam surface 20, which is positioned higher than the angled receiving surface 18, before moving by gravity onto angled receiving surface 18. The handle ends of knives that are dispensed from the stack located closer to the front 50 of the dispenser are dispensed so that they contact angled receiving surface 18 without contacting anti-jam surface 20.

Anti-jam surface 20 is sloped downwardly toward the front 40 of the tray 10 at an angle that is different from the degree of slope of angled receiving surface 18. In some embodiments, the degree of slope of the anti-jam surface is in the range of approximately 45°-90°, but other suitable angles may be used depending on the height from which the knife drops. In some embodiments, the slope of the anti-jam surface 20 is greater than the slope of the angled receiving surface 18 to help generate forward movement of the utensil and avoid an undesired hang-up of the utensil. This can be beneficial because knives that are dropped from the stack located more toward the back 48 of the dispenser do not fall as far as knives that are dropped from the stack located more toward the front 50 of the dispenser (because the contact surface is angled downwardly toward the front of the tray 40). Thus, knives that are dropped from the stack positioned closer to the front 50 of the dispenser have less room to rotate before landing in presentation area 24. On the other hand, knives that are dropped from the stack positioned closer to the back 48 of the dispenser have more room to rotate before landing in presentation area 24. Anti jam surface 20 is configured interrupt the drop and promote movement to the angled surface 18, thus increasing the chance that the knife rotates properly into the second orientation and comes to rest properly in presentation area 24. If dispenser 8 includes only one stack of knives, anti-jam surface 20 may not be necessary if the stack is properly positioned within the dispenser.

In some embodiments, tray 10 also includes a ledge 14 (FIGS. 2 and 5) that helps stop the rotation of the knife at about 45 degrees, or other suitable degree, so that the knife comes to rest on tray 10 in the desired second orientation. Specifically, ledge 14 is configured to curb the rotation of the knife that was imparted by angled receiving surface 18. Curbing the rotation avoids unwanted over-rotation that could cause the knife to fall out of dispensing tray 10. In this way, ledge 14 helps maintain the center of gravity of the knife within the tray 10 so that the knife comes to rest correctly within the presentation area 24. In particular, the knife has a tendency to flip out of the tray 10 as the knife rotates due to the center of gravity of the knife. The specific design of ledge 14 can be modified depending on the shape and/or size of the utensil being dispensed and thus on the center of gravity of the utensil to be dispensed. In the embodiment shown in FIG. 2, ledge 14 extends upwardly from drop area 12 at an angle of approximately 85-90 degrees, but other suitable angles may be used.

Tray 10 may also include a second sloped surface 16 (FIG. 2) that connects the anti-jam surface 20 with the ledge 14. In the embodiment shown in FIGS. 2-11, the second sloped surface 16 is sloped at approximately 30 degrees, but other suitable angles may be used. In some embodiments, the slope of surface 16 is such that it returns the utensil to the drop area 12 if the utensil over-rotates.

In some embodiments, tray 10 also includes one or more ribs 22 (FIG. 11) located along the right side 38 of tray 10. In other embodiments, ribs 22 are not necessary. Ribs 22 are configured to slow the speed at which the handle end of the knife moves toward the front 40 of the tray 10 and also prevent the handle end of the knife from riding too high on the wall 52 of the tray 10 (FIG. 3). The dimensions of the ribs 22 may be influenced by the length of the utensil. In particular, width W (FIG. 11) of the ribs 22 is generally inversely related to the length of the utensil (for example, the shorter the utensil is, the wider the ribs 22 are). This relationship ensures that the handle end of the knife makes contact with the ribs 22 if the knife is riding too high along the wall 52 of the tray 10 and has the potential to travel too fast.

In some embodiments, tray 10 includes one or more optional tabs 26, which help orient tray 10 properly within the dispenser 8, along the left and right sides 36, 38 of the tray 10. In embodiments where the dispensing of the knives is automated, the tabs 26 align the infrared emitter, the receiver, and the aperture 34. If tabs 26 are not used, there are many other suitable ways for aligning tray 10 within dispenser 8.

Figure 12:
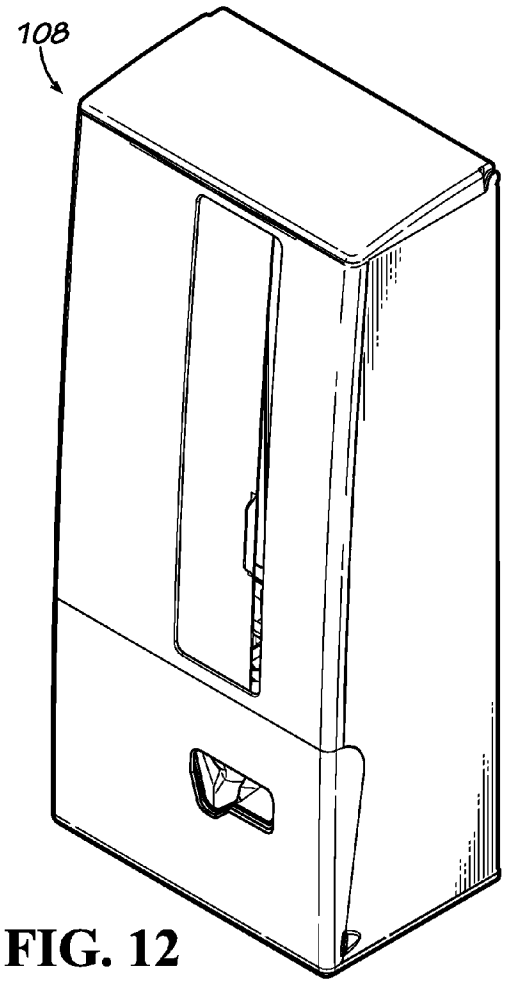
FIG. 12 is a front perspective view of a fork dispenser according to one embodiment.
Figure 14:
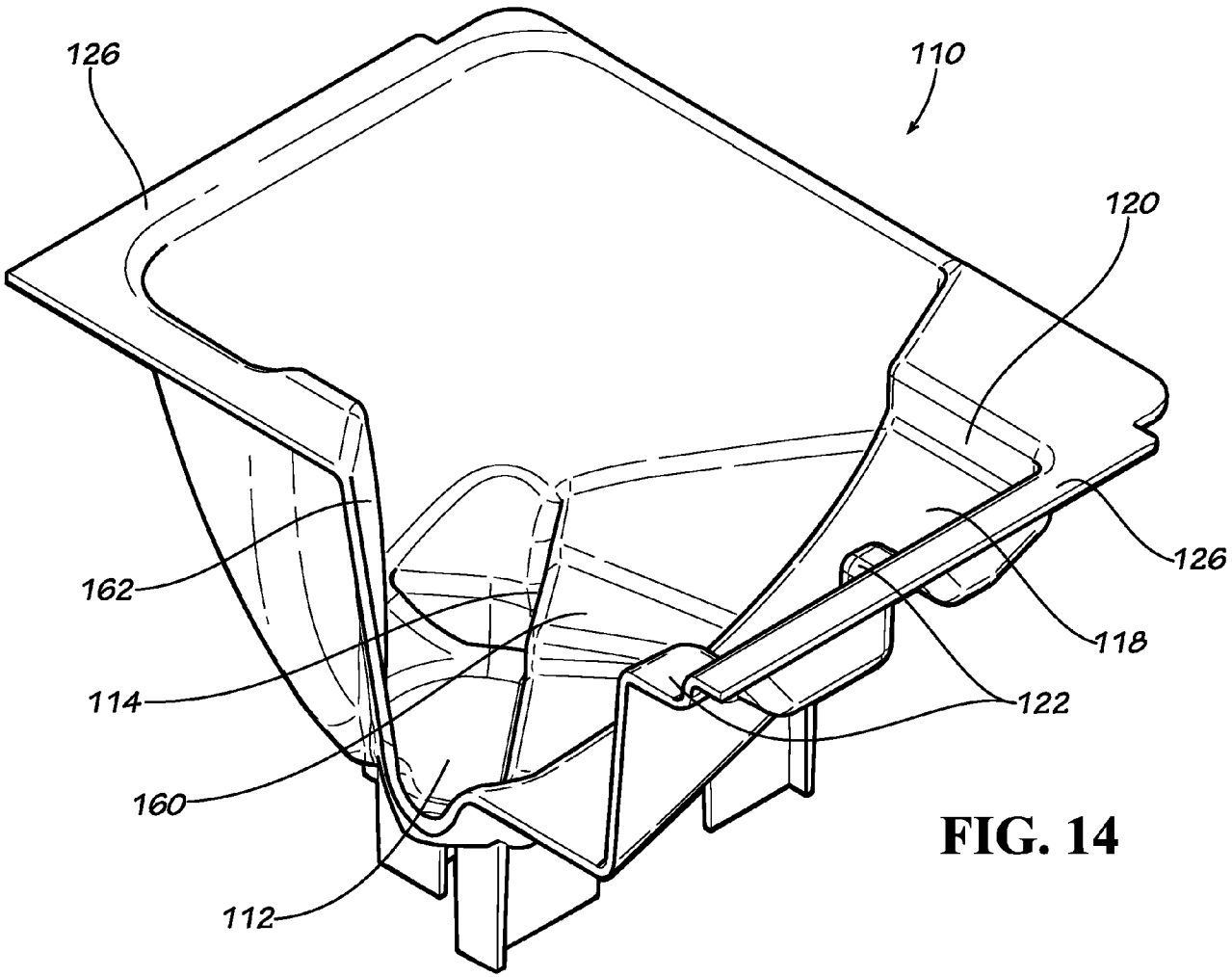
FIG. 14 is a front top perspective view of the fork tray of FIG. 13.
Figure 15:
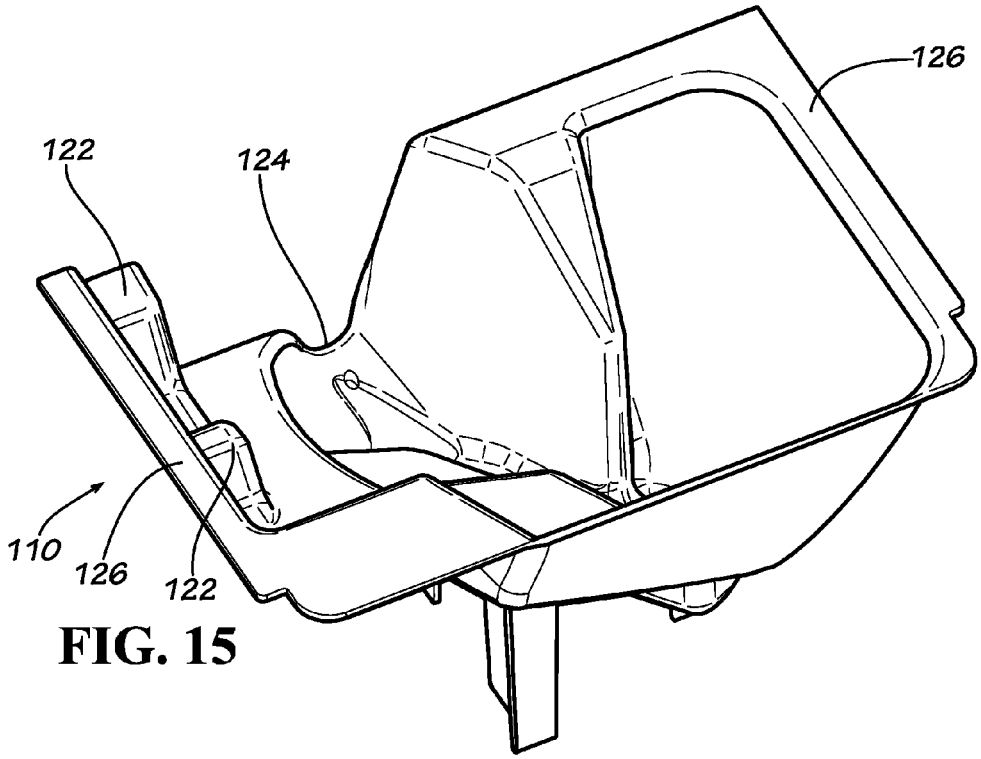
FIG. 15 is a rear top perspective view of the fork tray of FIG. 13.
Figure 16:
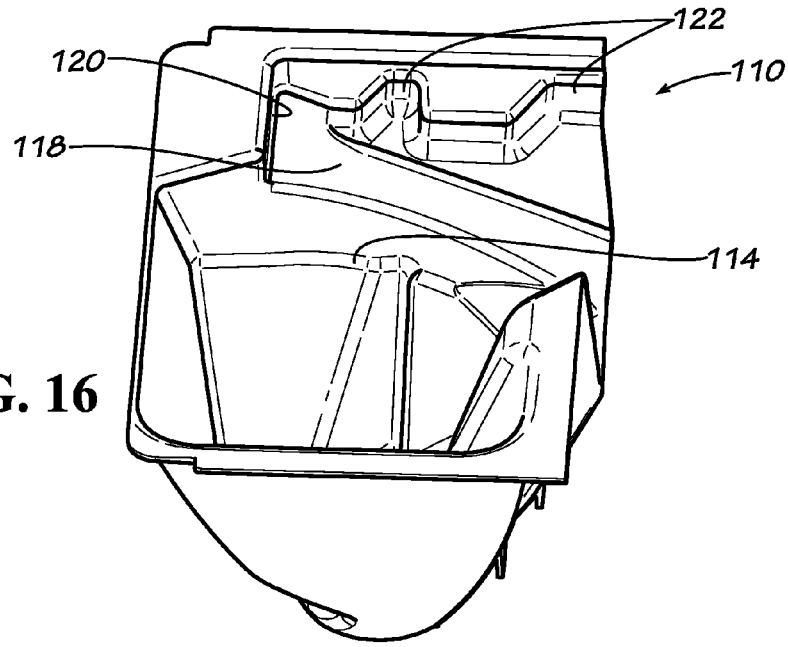
FIG. 16 is a side top perspective view of the fork tray of FIG. 13.
Figure 17:
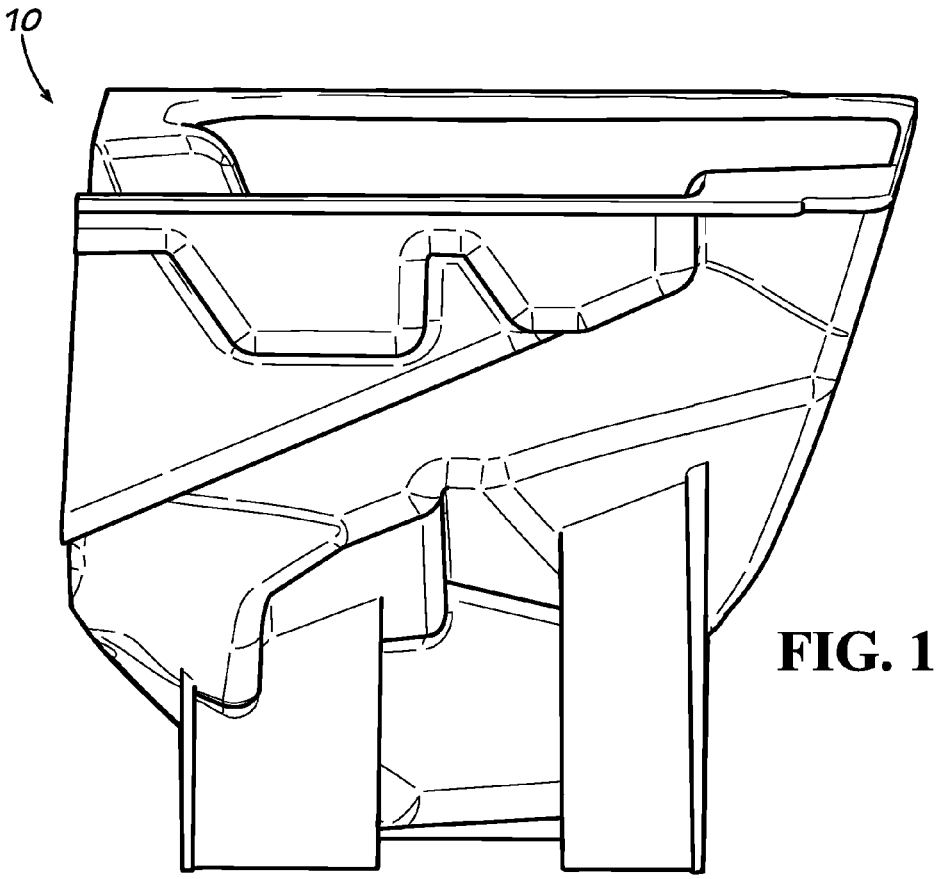
FIG. 17 is a right side perspective view of the fork tray of FIG. 13.
Figure 18:
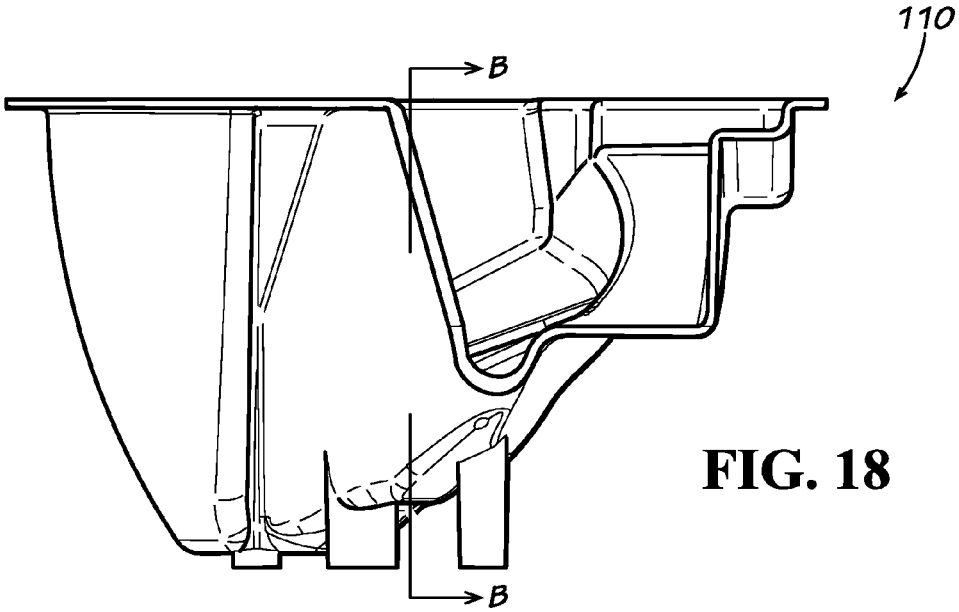
FIG. 18 is a front view of the fork tray of FIG. 13.
Figure 19:
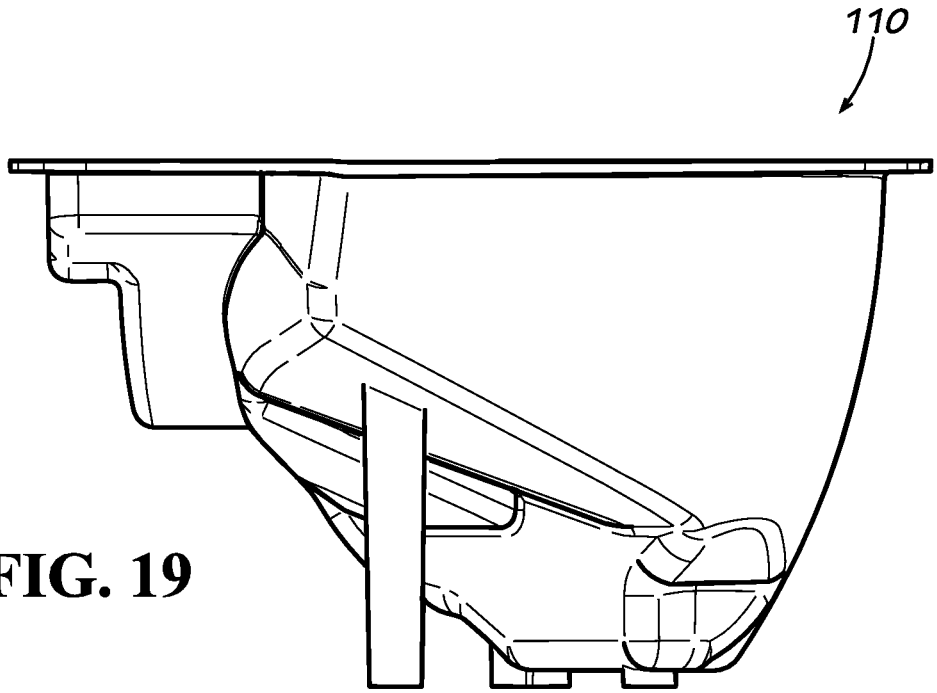
FIG. 19 is a rear view of the fork tray of FIG. 13.
Figure 20:
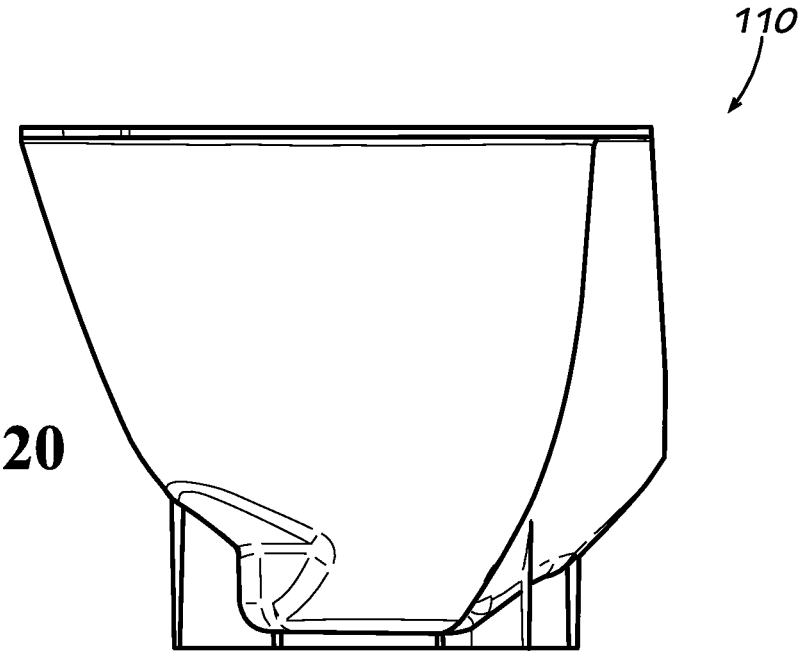
FIG. 20 is a left side view of the fork tray of FIG. 13.
Figure 21:
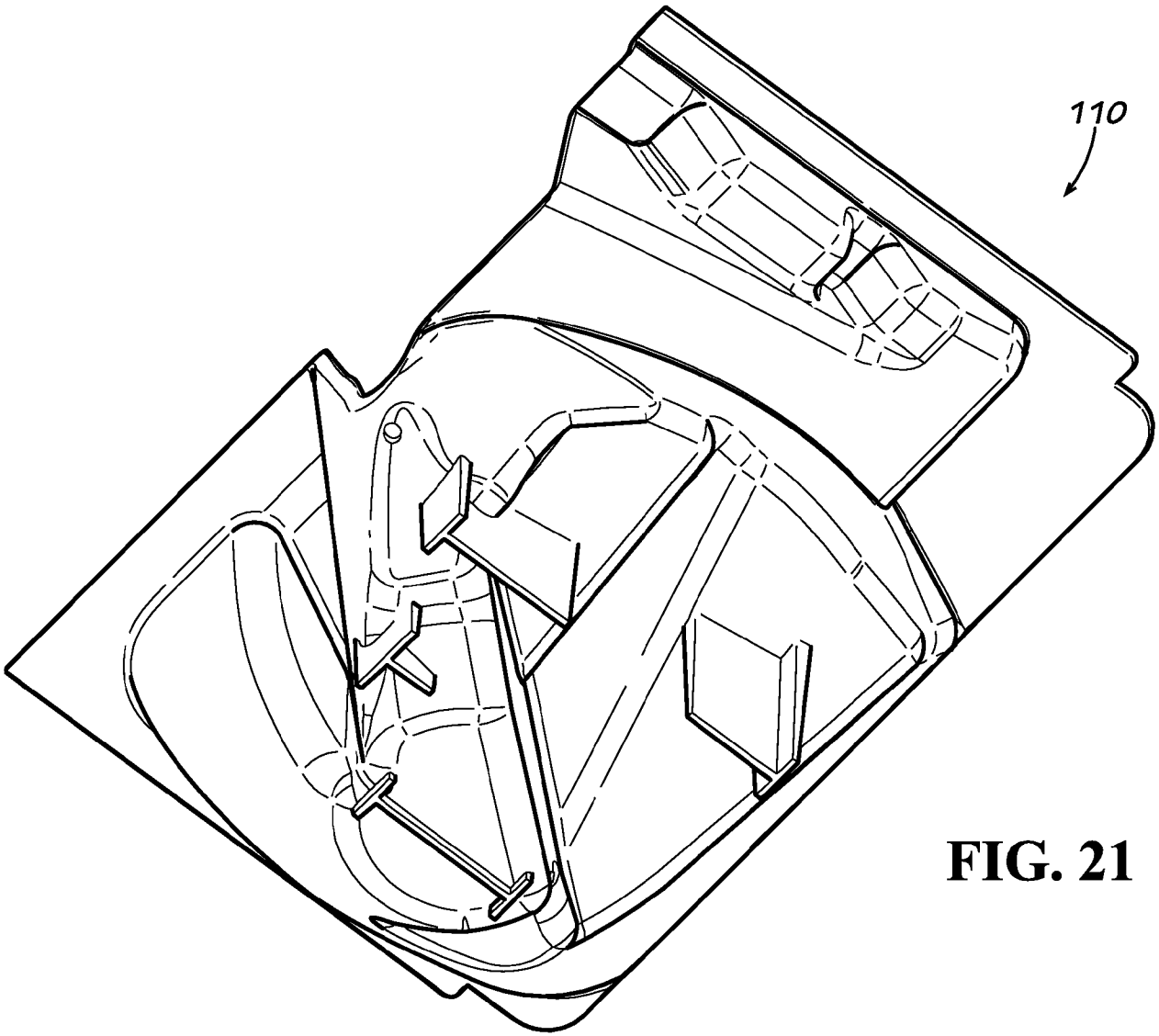
FIG. 21 is a bottom perspective view of the fork tray of FIG. 13.
Figure 22:
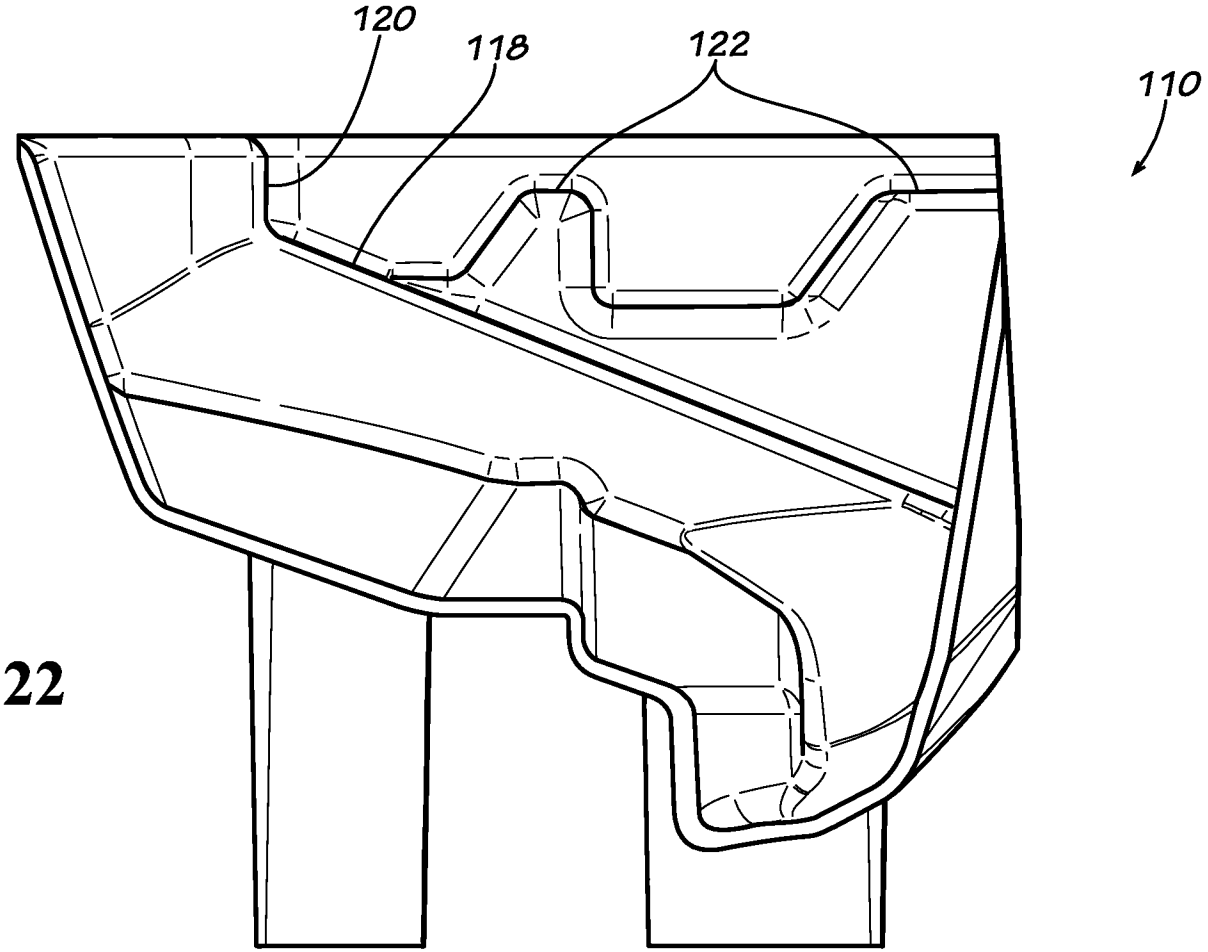
FIG. 22 is a cross-sectional view of the fork tray of FIG. 13, taken along the line B-B of FIG. 18.

FIG. 12 illustrates a fork dispenser 108 that is similar in design and operation to knife dispenser except that it houses forks instead of knives. Fork tray 110, shown in FIGS. 13-22, is configured to be received within fork dispenser 108, and shares many of the features discussed above with respect to knife tray 10, with some of the similarities and differences addressed below.

Like knife tray 10, fork tray 110 includes a presentation area 124 located along a front 140 of the tray 110. Presentation area 124 as shown in FIGS. 12-18 is similar to presentation area 24 discussed above, but like presentation area 24, could have different configurations in other embodiments. Fork tray 110 also includes a drop area 112, which is similar to drop area 12, except drop area 112 is larger to accommodate the dimensions of the utility end of the fork. Fork tray 110 also includes a channel 132 that connects the drop area 112 with the presentation area 124. Like channel 32, channel 132 may be tapered to correspond to the shape of the utensil (fork) to be received within channel 132.

Fork tray 110 also includes an angled receiving surface 118 that induces rotation of the fork from its first orientation to its second orientation as it drops into fork tray 110. Angled receiving surface 118 is similar to angled surface 18 discussed above. In some embodiments, the angled receiving surface 118 of the fork tray 110 may have an angle of between around 10 to around 60 degrees when associated with a drop height of 1-6 inches, but other suitable angles may be used. Like knife tray 10, fork tray 110 may also include an optional anti-jam surface 120. In some embodiments, however, the slope of the anti-jam surface 120 is greater than the slope of anti-jam surface 20, although that need not be the case. Anti-jam surface 120 may have a slope of between approximately 45°-90°.

Fork tray 110 may also include an optional ledge 114 to help curb the rotation of the fork imparted by angled receiving surface 118. If included, ledge 114 may extend upwardly from drop area 112 at an angle of approximately 85-90 degrees, but other suitable angles may be used. Like ledge 14, the design of ledge 114 can be modified depending on the shape and/or size of the fork being dispensed and the center of gravity of the fork to be dispensed. In embodiments where the ledge 114 is used, ledge 114 may be lower and smaller than ledge 14 because a fork has a tendency to spin less than a knife due to the greater weight associated with the utility end of the fork. In other embodiments, ledge 114 is not necessary because of the configuration (including the center of gravity) of a fork. Namely, a fork does not have as great of a tendency as a knife to become balanced on its side and/or flip out.

Fork tray 110 may also include a second sloped surface 116 (FIG. 13) that connects the anti-jam surface 120 with the ledge 114, and also may include one or more optional ribs 122 located along the right side 138 of the tray 110. Like ribs 22, the width W of the ribs 122 may be influenced by the length of the utensil to be dispensed. In other embodiments, the width W is not correlated with the length of the utensil. Fork tray 110 may also include optional assembly tabs 126, which are similar to tabs 26 discussed above.

In addition, in some embodiments, fork tray 110 includes an optional generally planar ledge 160 that extends from second sloped surface 116 and that helps prevent the fork from rolling on its side (as opposed to the bottom of the fork) and balancing on one of its side due to the center of gravity of the fork. In some embodiments, planar ledge 160 is substantially flat.

Fork tray 110 also may include an optional guide surface 162 that, in addition to planar ledge 160, helps prevent the fork from balancing on its side instead of landing within tray 110 in a flat position. Guide surface 162 projects from the presentation area 124 generally toward the back 142 of the tray 110.

Figure 23:
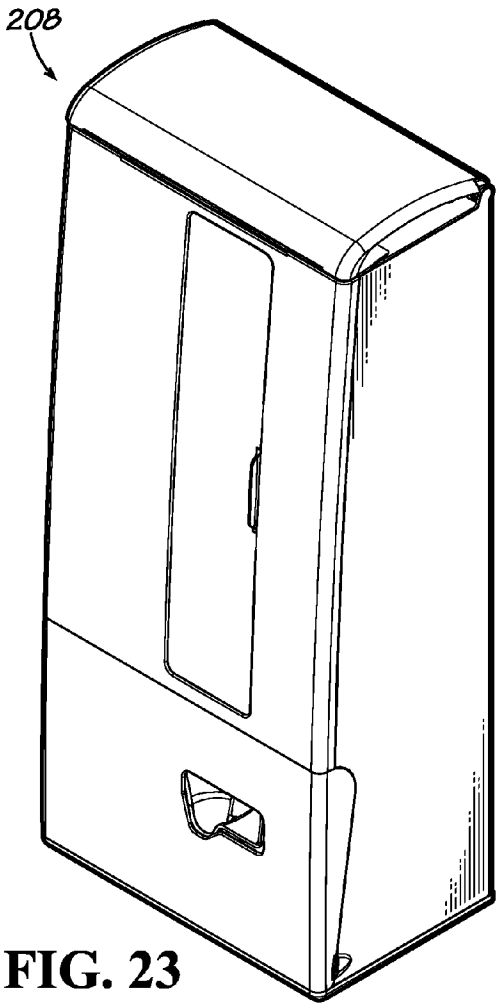
FIG. 23 is a front perspective view of a spoon dispenser according to one embodiment.

FIG. 23 illustrates a spoon dispenser 208 that is similar in design and operation to the knife and fork dispensers described above except that it houses spoons instead of knives or forks. Spoon tray 210, shown in FIGS. 24-33, is configured to be received within spoon dispenser 208, and shares many of the features discussed above with respect to knife tray 10.

Like knife tray 10, spoon tray 210 includes a presentation area 224 located along a front 240 of the tray 210. Presentation area 224 as shown in FIGS. 24-27 is similar to presentation area 24 discussed above, but, like presentation area 24, could have other configurations. Spoon tray 210 also includes a drop area 212, which is similar to drop areas 12 and 112, except drop area 212 is larger than drop areas 12 and 112 to accommodate the larger dimensions of the utility end of a spoon. Spoon tray 210 also includes a channel 232 that connects the drop area 212 with the presentation area 224. Like channels 32 and 132, channel 232 may be tapered to correspond to the shape of the utensil (spoon) to be received within channel 232.

Spoon tray 210 also includes an angled receiving surface 218 that helps rotate the spoon from a first orientation to a second orientation as it drops into spoon tray 210. Angled receiving surface 218 is similar to angled receiving surface 18 discussed above. In some embodiments, the angled receiving surface 218 of the spoon tray 210 may have an angle of between around 10 to around 60 degrees when associated with a drop height of 1-6 inches, but other suitable angles may be used. Like knife tray 10, spoon tray 210 may also include an optional anti-jam surface 220. Anti-jam surface 220 generally has a slope of between approximately 45°-90°.

Spoon tray 210 may also include a ledge 214 to help curb the rotation of the spoon imparted by angled receiving surface 218. If included, ledge 214 extends upwardly from drop area 212 at an angle of approximately 85-90 degrees, but other suitable angles may be used. Specifically, like ledge 14, the design of ledge 214 can be modified depending on the shape and/or size of the spoon being dispensed and the center of gravity of the spoon to be dispensed. In some embodiments, ledge 214 is not necessary for use with spoon tray 210 because of the configuration (including the center of gravity) of a spoon.

Figure 24:
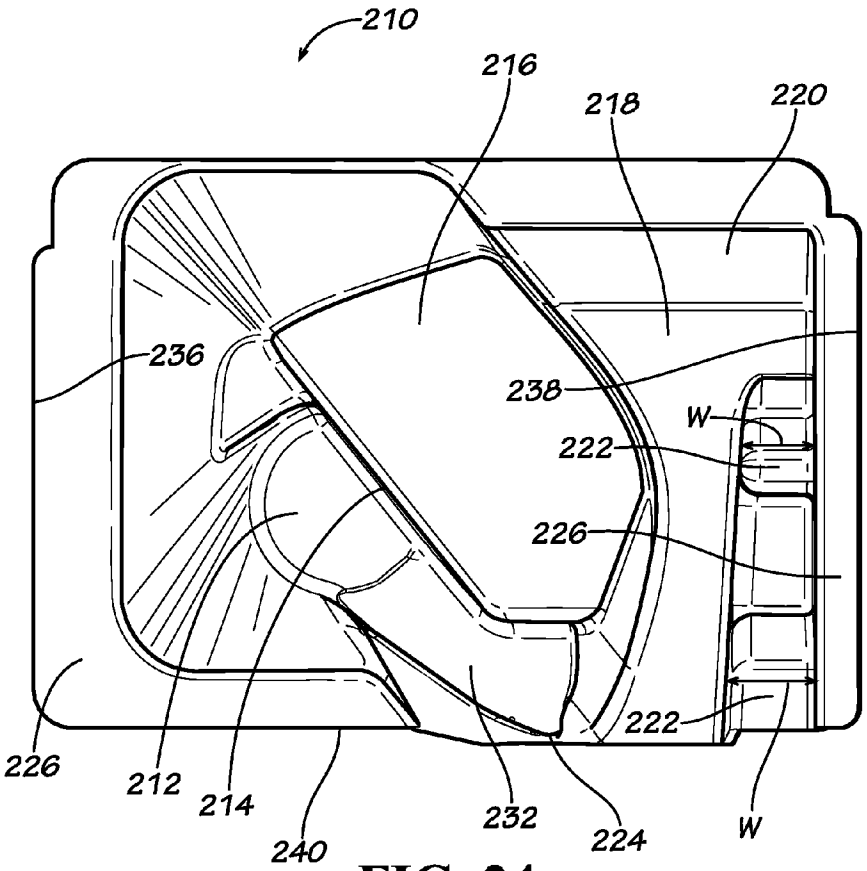
FIG. 24 is a top view of a spoon tray to be used with the spoon dispenser of FIG. 23.
Figure 25:
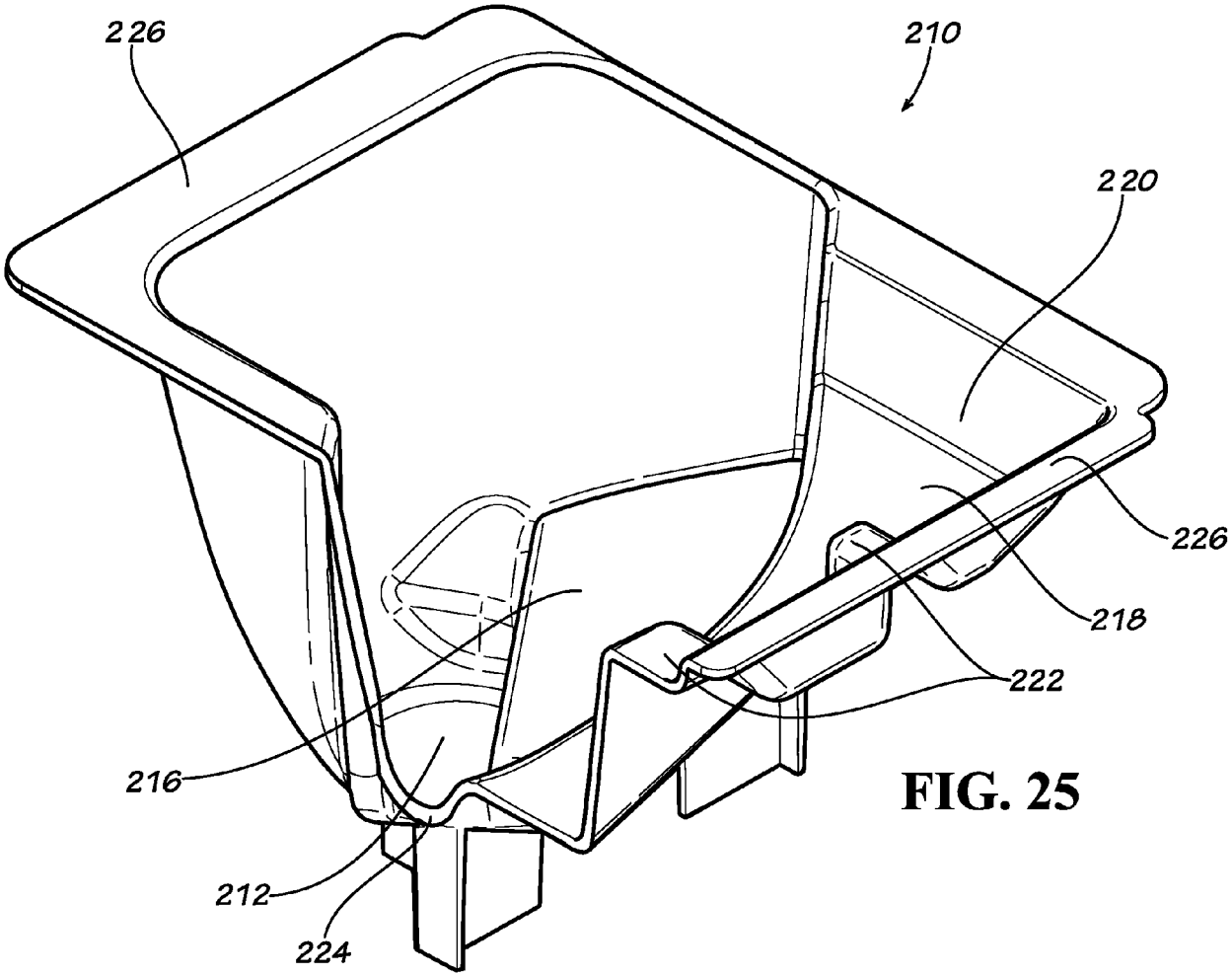
FIG. 25 is a front top perspective view of the spoon tray of FIG. 24.
Figure 26:
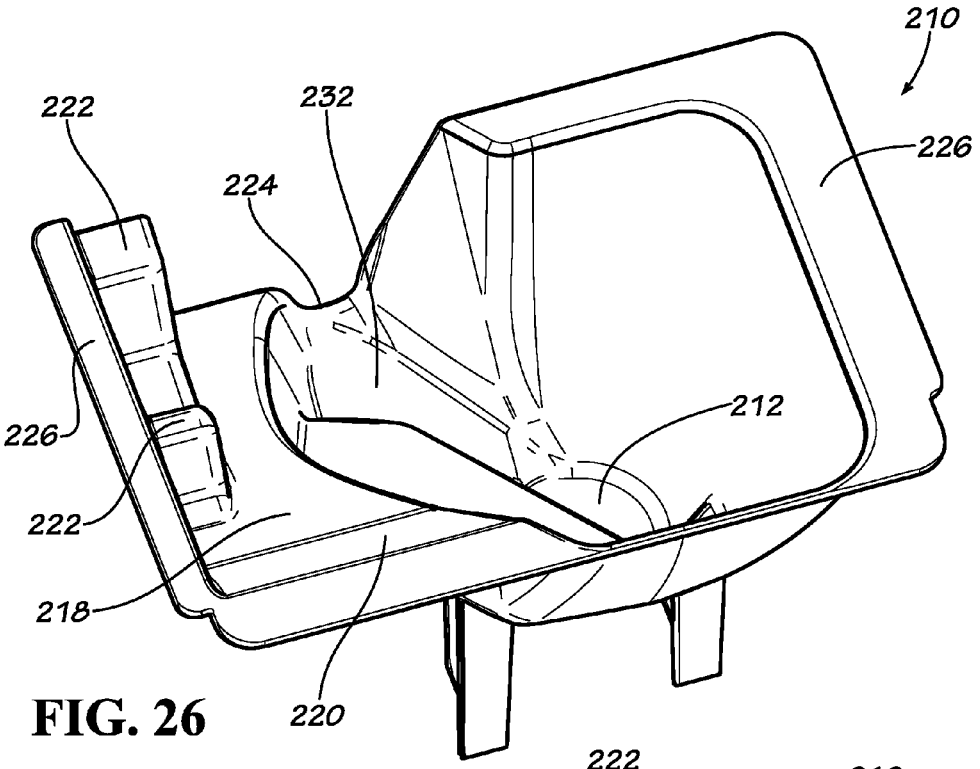
FIG. 26 is a rear top perspective view of the spoon tray of FIG. 24.
Figure 27:
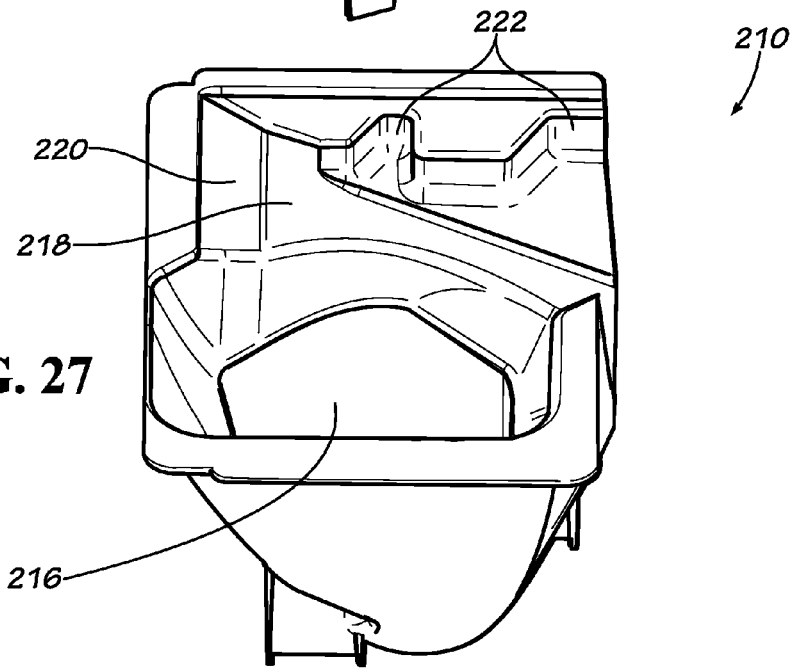
FIG. 27 is a side top perspective view of the spoon tray of FIG. 24.
Figure 28:
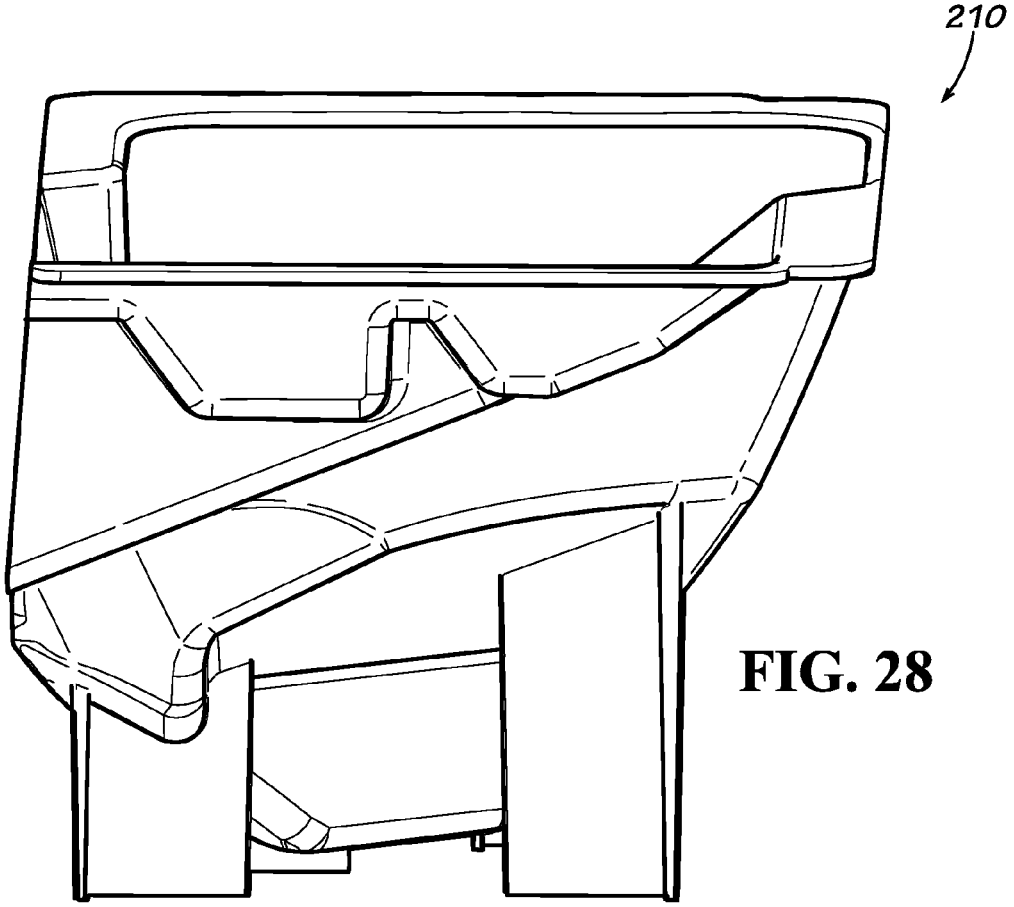
FIG. 28 is a right side perspective view of the spoon tray of FIG. 24.
Figure 29:
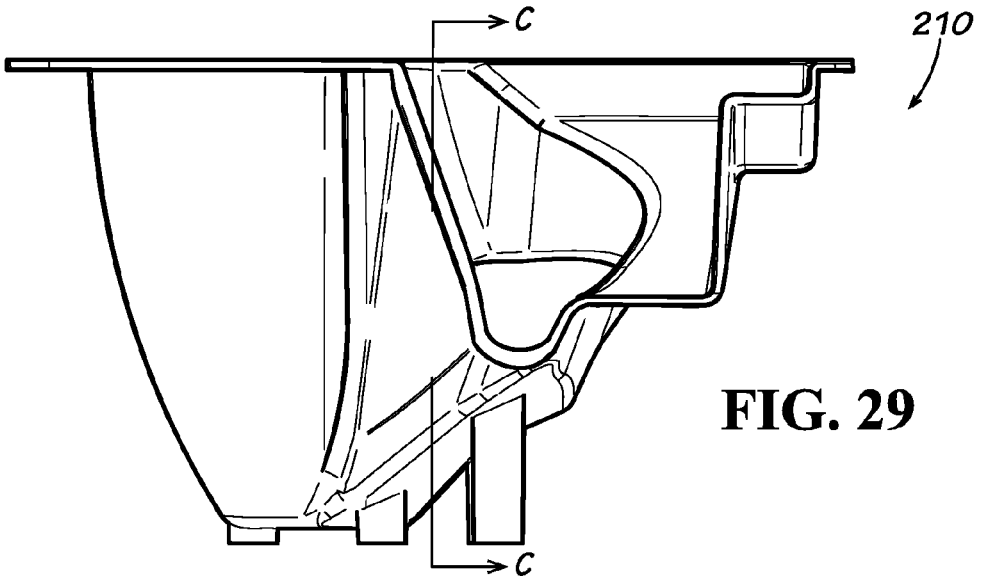
FIG. 29 is a front view of the spoon tray of FIG. 24.
Figure 30:
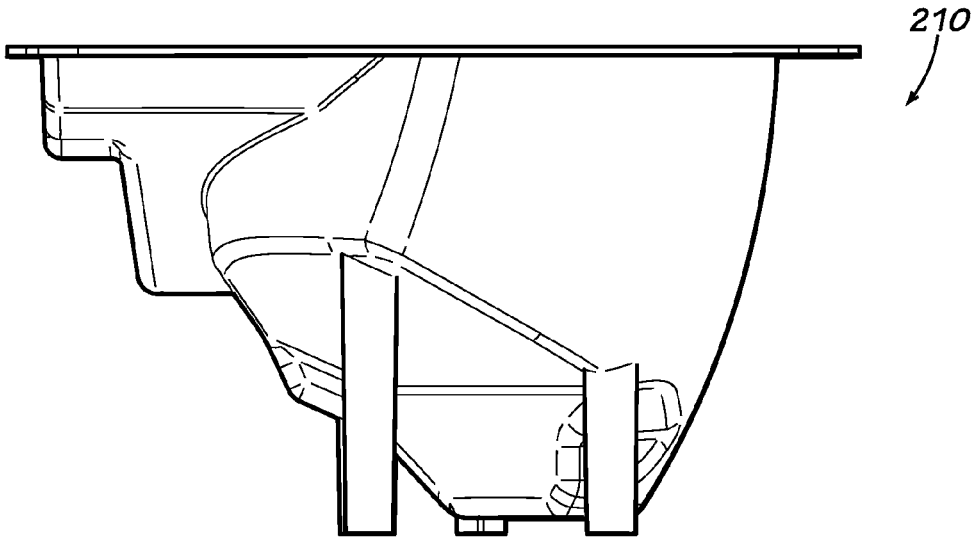
FIG. 30 is a rear view of the spoon tray of FIG. 24.
Figure 31:
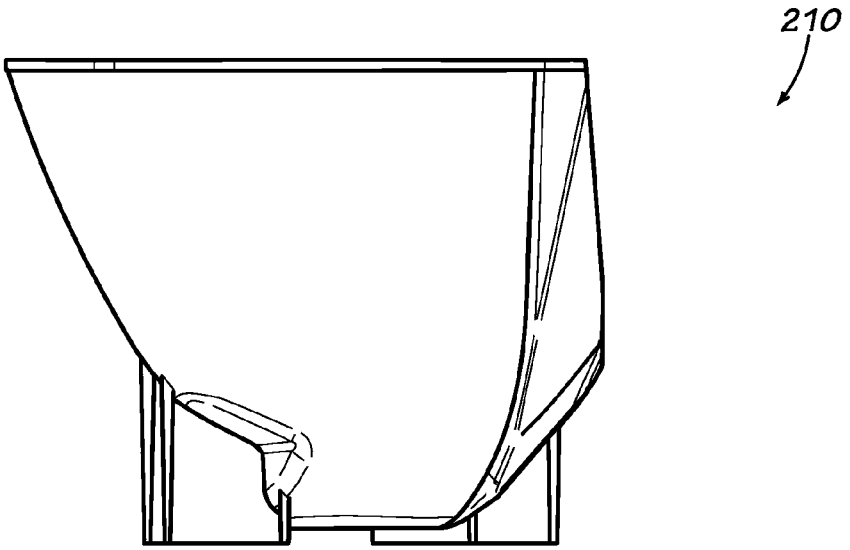
FIG. 31 is a left side view of the spoon tray of FIG. 24.
Figure 32:
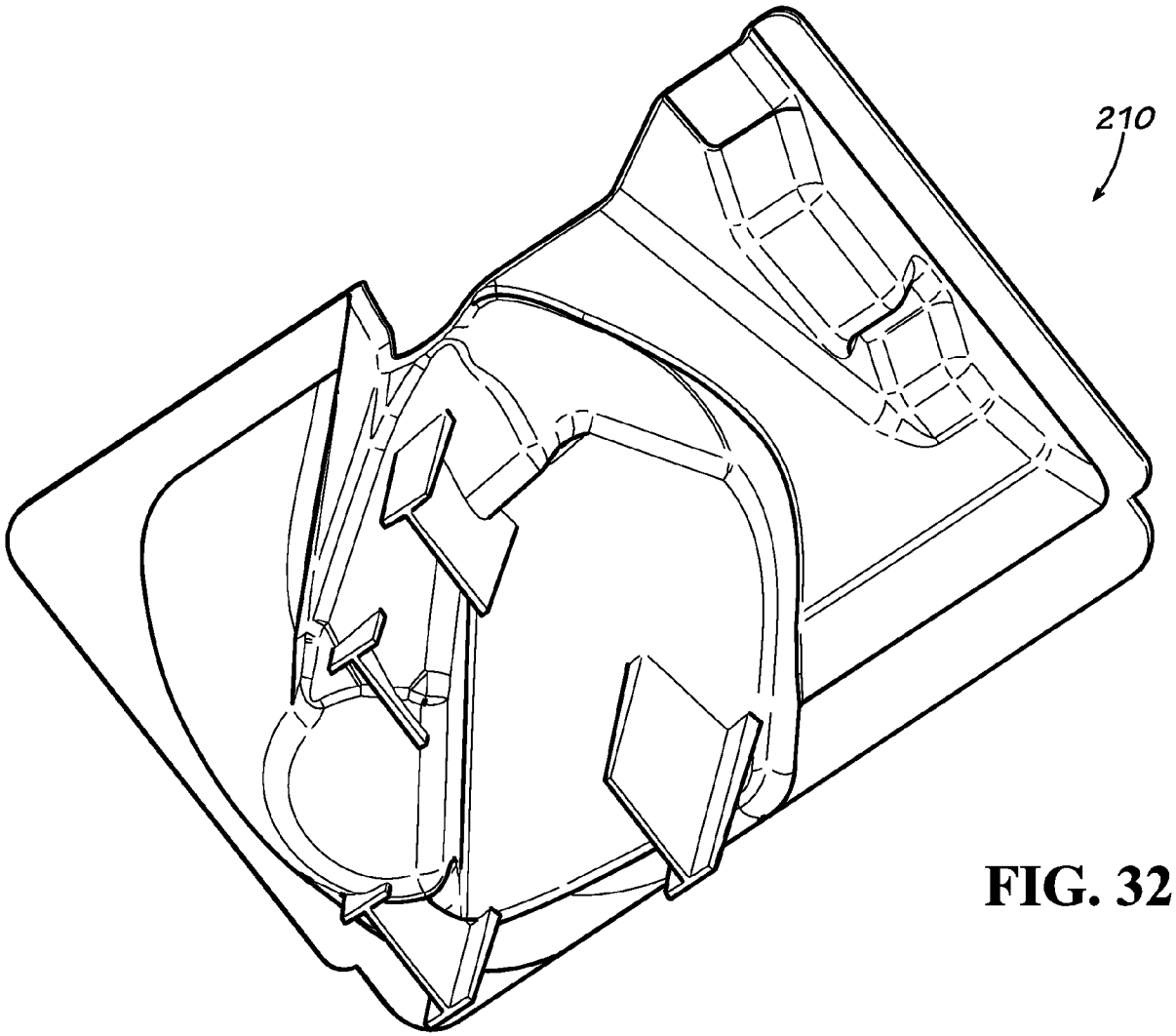
FIG. 32 is a bottom perspective view of the spoon tray of FIG. 24.
Figure 33:
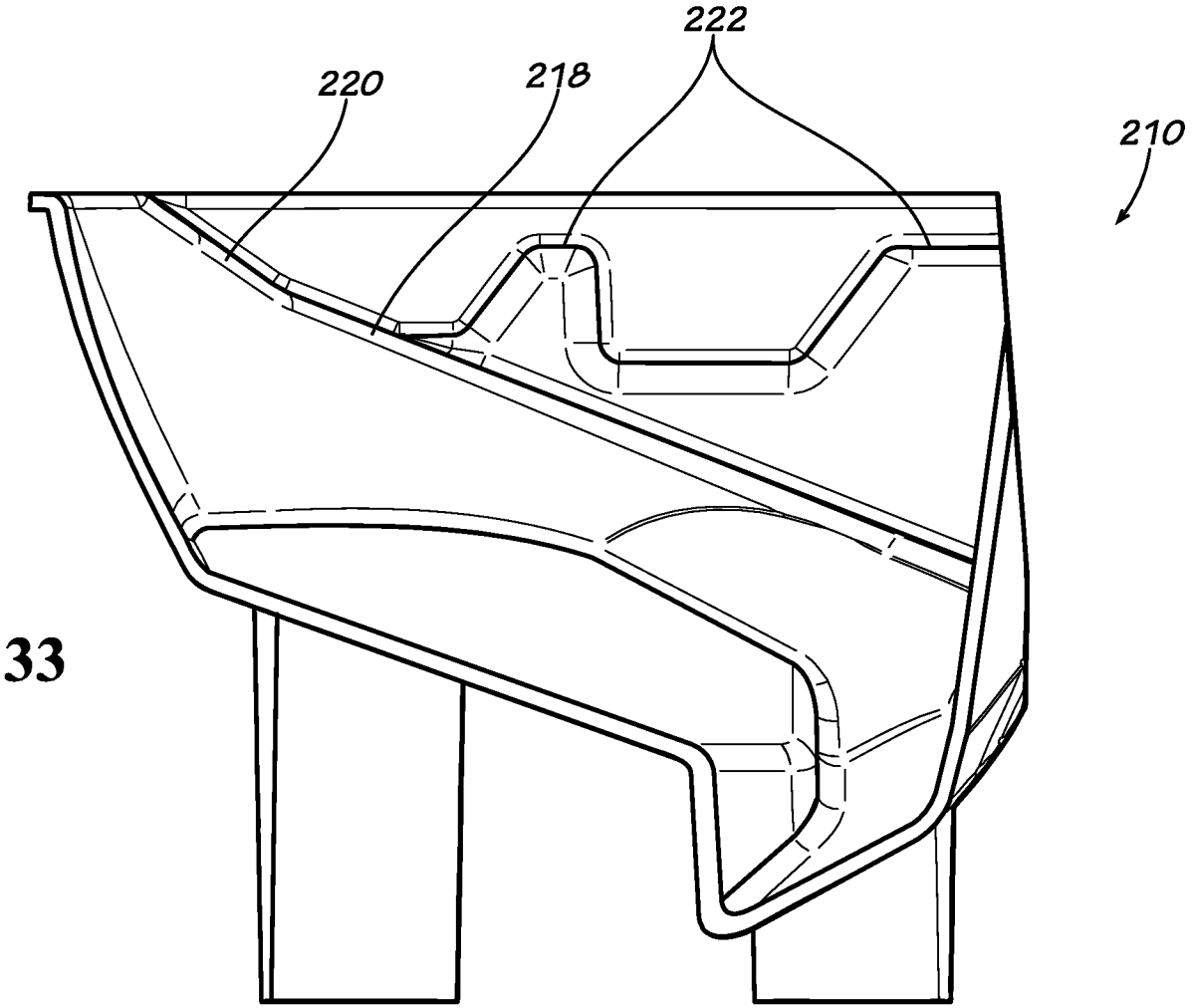
FIG. 33 is a cross-sectional view of the spoon tray of FIG. 24, taken along the line C-C of FIG. 29.

Spoon tray 210 may also include a second sloped surface 216 (FIG. 24) that connects the anti-jam surface 220 with the ledge 214, and also may include one or more optional ribs 222 located along the right side 238 of the tray 210. Like ribs 22, the width W of the ribs 222 may be influenced by the length of the utensil to be dispensed. In other embodiments, the width W is not correlated with the length of the utensil. Spoon tray 210 may also include optional assembly tabs 226, which are similar to tabs 26 discussed above. As shown in FIGS. 24-25, tab 226 may be wider on the left side 236 of the tray 210 than the right side 238 in some embodiments as dictated by the dimensions of the tray 210.

The dimensions of the trays 10, 110, and 210, as well as the dimensions of the various features discussed above and the location of these features within the trays, may vary depending on the dimensions of and the materials used to form the utensils to be received within the trays.

Similarly, Trays 10, 110, and 210 are formed of any suitable material. In the embodiment shown in the Figures, the trays are formed from thermoplastic materials, but any suitable materials, such as urethane may be used. Trays 10, 110, and 210 may be formed from molds, such as vacuum formed molds, or by any other suitable method.

Numerous modifications of this invention may be made in the composition, application, manufacturing process and other aspects of this invention without departing from the objectives and spirit of the description above and in the Figures.

The invention claimed is:

1. A cutlery dispenser comprising:

(a) a housing for storing one or more stacks of utensils in a first orientation;

(b) a tray located below the one or more stacks of utensils and configured to receive a piece of cutlery from the one more stacks of utensils, the tray further comprising:
(i) a front and at least one side;
(ii) a presentation area positioned along the front of the tray;
(iii) a drop area for receiving a utility end of the piece of cutlery, wherein the drop area is not in the same plane as the presentation area;
(iv) a channel connecting the drop area and the presentation area;
(v) an angled receiving surface for receiving the piece of cutlery, the angled receiving surface located on the at least one side of the tray, wherein a handle end of the piece of cutlery contacts the angled receiving surface and is adapted to move ahead of the utility end of the piece of cutlery; and
(vi) a ledge for preventing over-rotation of the piece of cutlery as it rotates into a second orientation after contacting the angled receiving surface, the ledge promoting correct positioning of the piece of cutlery within the presentation area of the tray; and
(c) a presentation opening that is at least partially aligned with the presentation area of the tray.

2. The cutlery dispenser of claim 1, wherein the housing of the dispenser stores two stacks of utensils.

3. The cutlery dispenser of claim 1, wherein the channel is shaped to receive one of a fork, a spoon, a knife or a spork.

4. The cutlery dispenser of claim 2, further comprising an anti-jam surface, at least a portion of the anti-jam surface located behind and positioned higher than the angled receiving surface.

5. The cutlery dispenser of claim 1, wherein the slope of the angled receiving surface is between approximately 10 degrees and approximately 60 degrees.

6. The cutlery dispenser of claim 4, further comprising a second sloped surface connecting the anti-jam surface with the ledge.

7. The cutlery dispenser of claim 1, further comprising one or more tabs for properly aligning the tray within the dispenser.

8. The cutlery dispenser of claim 1, further comprising a generally planar ledge that extends from the second sloped surface, the generally planar ledge adapted to maintain the utility end of a dispensed piece of cutlery lower than the handle end of the cutlery as the dispensed piece of cutlery rotates toward the presentation area into the second orientation.

9. The cutlery dispenser of claim 1, wherein the dispenser further comprises a sensor and wherein the presentation area of the tray further comprises an aperture through which a beam associated with the sensor passes.

10. The cutlery dispenser of claim 4, wherein a slope of the anti-jam surface is between approximately 45 degrees and approximately 90 degrees.

11. The cutlery dispenser of claim 1, further comprising one or more ribs on the at least one side of the tray, the one or more ribs adapted to contact the handle end of the piece of cutlery, wherein a dimension of the one or more ribs is generally inversely related to a length of the piece of cutlery.

12. A tray for use within a cutlery dispenser for receiving and presenting single utensils, the tray comprising:
(a) a front, a back, and two sides;
(b) a presentation area positioned along the front of the tray;
(c) a drop area for receiving a utility end of one of the single utensils, the drop area positioned in a plane lower than a plane of the presentation area;
(d) a channel connecting the drop area and the presentation area, wherein the channel receives a mid-section of the utensil;
(e) an angled utensil receiving surface located on one of the two sides of the tray such that when a handle end of the utensil contacts the angled receiving surface, the handle end is adapted to move toward the presentation area ahead of the utility end of the utensil; and
(f) a ledge adapted to prevent rotation of the utensil beyond about 45 degrees after the utensil contacts the angled receiving surface.

13. The tray of claim 12, wherein the presentation area further comprises an aperture that corresponds to a sensing beam.

14. The tray of claim 12, further comprising an anti-jam surface, at least a portion of the anti-jam surface located behind and positioned higher than the angled receiving surface.

15. The tray of claim 14, wherein a slope of the anti-jam surface is between approximately 45 degrees and approximately 90 degrees.

16. The tray of claim 12, further comprising ribs on at least one of the sides of the tray, the ribs adapted to contact the handle of the utensil, wherein the dimension of the ribs is generally inversely related to a length of the utensil.

17. The tray of claim 12, further comprising tabs for aligning the tray within the dispenser.

18. The tray of claim 12, wherein the slope of the angled utensil receiving surface is between approximately 10 degrees and approximately 60 degrees.

19. The tray of claim 15, further comprising a second sloped surface connecting the anti-jam surface with the ledge.

20. A tray for use within a cutlery dispenser for receiving and presenting utensils, the tray comprising:
(a) a front, a back, and two sides;
(b) a presentation area positioned along the front of the tray;
(c) a drop area for receiving a utility end of one of the utensils, the drop area positioned in a plane lower than a plane of the presentation area;
(d) a channel connecting the drop area and the presentation area, wherein the channel receives a mid-section of the utensil; and
(e) an angled utensil receiving surface located on one of the two sides of the tray, wherein a handle of the utensil contacts the angled utensil receiving surface and is adapted to move toward the presentation area ahead of the utility end of the utensil.

21. The tray of claim 20, wherein the presentation area further comprises an aperture that corresponds to a sensing beam.

22. The tray of claim 20, further comprising an anti-jam surface, at least a portion of the anti-jam surface located behind and positioned higher than the angled receiving surface.

23. The tray of claim 22, wherein a slope of the anti-jam surface is between approximately 45 degrees and approximately 90 degrees.

24. The tray of claim 20, further comprising ribs on a right side of the tray, the ribs adapted to contact the handle of the utensil, wherein the dimension of the ribs is generally inversely related to a length of the utensil.

25. The tray of claim 20, further comprising tabs for aligning the tray within the dispenser.

26. The tray of claim 20, wherein the slope of the angled utensil receiving surface is between approximately 10 degrees and approximately 60 degrees.

27. The tray of claim 22, further comprising a ledge for preventing rotation of the utensil beyond about 45 degrees after the utensil contacts the angled utensil receiving surface.

28. The tray of claim 23, further comprising a second sloped surface connecting the anti-jam surface with the ledge.

29. A tray for use within a cutlery dispenser for receiving and presenting forks, the tray comprising:

(a) a front, a back, and two sides;

(b) a presentation area positioned along the front of the tray;

(c) a drop area for receiving a utility end of one of the forks, the drop area positioned in a plane below a plane of the presentation area;

(d) a channel connecting the drop area and the presentation area, the channel for receiving a mid-section of the fork; and (e) an angled fork receiving surface located on one of the two sides of the tray, wherein a handle of the fork contacts the angled fork receiving surface and is adapted to move toward the presentation area ahead of the utility end of the fork.

30. The tray of claim 29, wherein the presentation area further comprises an aperture that corresponds to a sensing beam.

31. The tray of claim 29, further comprising an anti-jam surface, at least a portion of the anti jam surface located behind and positioned higher than the angled receiving surface.

32. The tray of claim 31, wherein a slope of the anti jam surface is between approximately 45 degrees and approximately 90 degrees.

33. The tray of claim 29, further comprising ribs on a right side of the tray, the ribs adapted to contact the handle of the fork, wherein the dimension of the ribs is generally inversely related to a length of the fork.

34. The tray of claim 29, further comprising tabs for aligning the tray within the dispenser.

35. The tray of claim 29, wherein the slope of the angled fork receiving surface is between approximately 10 degrees and approximately 60 degrees.

36. The tray of claim 31, further comprising a first ledge adapted to prevent rotation of the fork beyond about 45 degrees after the fork contacts the angled fork receiving surface.

37. The tray of claim 36, further comprising a second sloped surface connecting the anti-jam surface with the first ledge.

38. The tray of claim 37, further comprising a generally planar ledge that extends from the second sloped surface, the generally planar ledge positioned to maintain the utility end of the fork lower than the handle end of the fork as the fork rotates toward the presentation area.

39. The tray of claim 31, further comprising a guide surface that projects from the presentation area toward the back of the tray to help prevent the fork from balancing on one of its sides.

* * * * *